US008662637B2

(12) United States Patent
Ishimoto et al.

(10) Patent No.: US 8,662,637 B2
(45) Date of Patent: Mar. 4, 2014

(54) FLUID EJECTING APPARATUS AND FLUID EJECTING METHOD

(75) Inventors: Bunji Ishimoto, Nagano-ken (JP); Yumiko Takeda, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 690 days.

(21) Appl. No.: 12/833,725

(22) Filed: Jul. 9, 2010

(65) Prior Publication Data

US 2011/0027490 A1 Feb. 3, 2011

(30) Foreign Application Priority Data

Jul. 31, 2009 (JP) ..... 2009-178779

(51) Int. Cl.
*B41J 2/21* (2006.01)

(52) U.S. Cl.
USPC ..... 347/43; 347/42; 347/12

(58) Field of Classification Search
USPC ..... 347/19, 43, 104, 12, 14, 42
See application file for complete search history.

(56) References Cited

U.S. PATENT DOCUMENTS

| | | | | |
|---|---|---|---|---|
| 6,527,360 | B2 * | 3/2003 | Otsuki et al. | 347/19 |
| 7,407,277 | B2 | 8/2008 | Yoneyama | |
| 2006/0158481 | A1 * | 7/2006 | Spevak et al. | 347/43 |

FOREIGN PATENT DOCUMENTS

| | | |
|---|---|---|
| JP | 2003-326779 A | 11/2003 |
| JP | 2008-221645 | 9/2008 |

* cited by examiner

*Primary Examiner* — Lam S Nguyen

(57) ABSTRACT

A fluid ejecting apparatus includes first and second rows of nozzles ejecting first and second fluids respectively. A control section repeats an image formation operation ejecting fluid from the first and second nozzles while moving them perpendicularly to the row direction and controls transportation of the medium in the row direction. After formation of a first image layer by the first and second fluids, a second image layer is formed thereon by the second fluid. For normal image formation, the first and second nozzles forming the first image layer are further upstream in the row direction than the second nozzles forming the second image layer, and for image formation of an upper end of the medium, the first and second nozzles forming the first image layer are further downstream in the row direction than the first and second nozzles forming the first image layer in normal image formation.

6 Claims, 15 Drawing Sheets

FLUID EJECTING APPARATUS AND FLUID EJECTING METHOD

CROSS-REFERENCE TO RELATED APPLICATION(S)

Japanese Patent application No. 2009-178779 is incorporated by reference herein in its entirety.

BACKGROUND

1. Field of Invention

The present invention relates to a fluid ejecting apparatus and a fluid ejecting method.

2. Description of Related Art

As one of the fluid ejecting apparatuses, an ink jet printer having nozzle rows in which nozzles that eject ink (fluid) onto a medium are arranged in a row in a given direction is given. Among the ink jet printers, there is known a printer in which an operation for ejecting ink from nozzles while moving nozzle rows in a moving direction intersecting a given direction and an operation for transporting a medium with respect to the nozzle rows in a transport direction which is the given direction are repeated.

There is proposed a printing method in which in such a printer, for example, in the case of forming dot rows at intervals narrower than the nozzle arrangement intervals (nozzle pitch), the number of nozzles used or a transport distance of the medium is changed at the time of the printing of the upper end portion of the medium.

JP-A-2008-221645 is an example of the related art.

Incidentally, in order to increase a color-producing property of an image, for example, there is a case where after the printing of a background image by white ink, an image is printed on the background image by color ink. Also, since even in ink which is called the same white ink, a color is often different, there is a case where a white image of a desired color is printed by using white ink and a color ink. In this case, for example, the nozzles for printing a background image are fixed to the nozzles of a half on the upstream side in a transport direction of each of a white nozzle row and a color nozzle row, and the nozzles for printing a color image are fixed to the nozzles of a half on the downstream side in the transport direction of a color ink nozzle row. Then, since a background image is first printed by the white ink nozzles and the color ink nozzles on the upstream side in the transport direction, a print start position is on the upstream side in the transport direction with respect to a head. That is, a position control range of the medium becomes longer.

SUMMARY OF INVENTION

An advantage of some aspects of the invention is that it makes a position control range of a medium as short as possible.

According to a first aspect of the invention, there is provided a fluid ejecting apparatus including: (1) a first nozzle row in which first nozzles that eject first fluid are arranged in a row in a given direction; (2) a second nozzle row in which second nozzles that eject second fluid are arranged in a row in the given direction; (3) a movement mechanism which moves the first nozzle row and the second nozzle row with respect to a medium in a moving direction intersecting the given direction; (4) a transport mechanism which transports the medium with respect to the first nozzle row and the second nozzle row in the given direction; and (5) a control section which repeats an image formation operation for ejecting fluid from the first nozzles and the second nozzles while moving the first nozzle row and the second nozzle row in the moving direction by the movement mechanism and a transport operation for transporting the medium with respect to the first nozzle row and the second nozzle row in the given direction by the transport mechanism, wherein in a case where after the formation of a first image by the first fluid and the second fluid in a certain image formation operation, a second image is formed on the first image by the second fluid in another image formation operation, at the time of normal image formation, the first nozzles and the second nozzles for forming the first image are set to be nozzles which are located further on the upstream side in the given direction than the second nozzles for forming the second image, and at the time of image formation of an upper end portion of the medium, the first nozzles and the second nozzles for forming the first image are set to be nozzles which are located further on the downstream side in the given direction than the first nozzles and the second nozzles for forming the first image at the time of the normal image formation.

Other aspects of the invention will become apparent from the description of this specification and the accompanying drawings.

BRIEF DESCRIPTION OF THE DRAWINGS

The invention will be described with reference to the accompanying drawings, wherein like numbers reference like elements.

DESCRIPTION OF THE PREFERRED EMBODIMENTS

Figure 1:
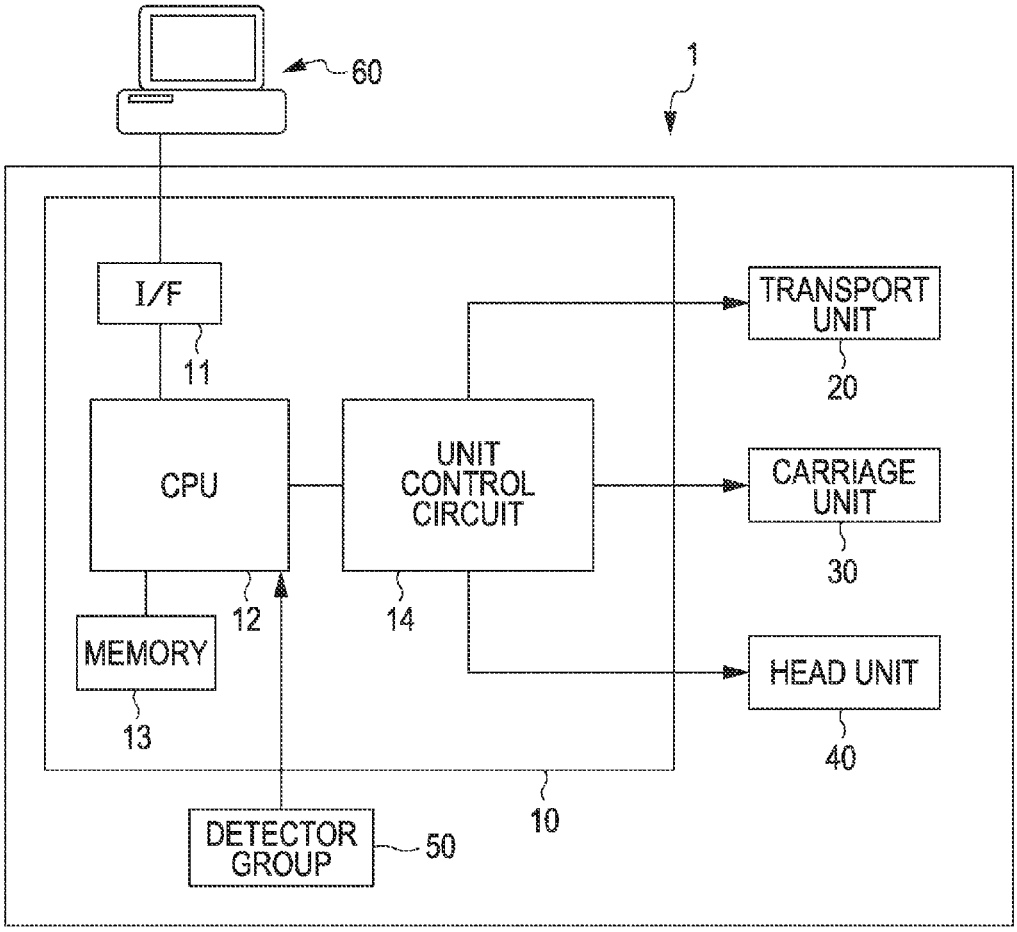
FIG. 1 is a block diagram showing the entire configuration of a printer.

At least the following aspects will become apparent from the description of this specification and the accompanying drawings.

That is, according to a first aspect of the invention, there is provided a fluid ejecting apparatus including: (1) a first nozzle row in which first nozzles that eject first fluid are arranged in a row in a given direction; (2) a second nozzle row in which second nozzles that eject second fluid are arranged in a row in the given direction; (3) a movement mechanism which moves the first nozzle row and the second nozzle row with respect to a medium in a moving direction intersecting the given direction; (4) a transport mechanism which transports the medium with respect to the first nozzle row and the second nozzle row in the given direction; and (5) a control section which repeats an image formation operation for ejecting fluid from the first nozzles and the second nozzles while moving the first nozzle row and the second nozzle row in the moving direction by the movement mechanism and a transport operation for transporting the medium with respect to the first nozzle row and the second nozzle row in the given direction by the transport mechanism, wherein in a case where after the formation of a first image by the first fluid and the second fluid in a certain image formation operation, a second image is formed on the first image by the second fluid in another image formation operation, at the time of normal image formation, the first nozzles and the second nozzles for forming the first image are set to be nozzles which are located further on the upstream side in the given direction than the second nozzles for forming the second image, and at the time of image formation of an upper end portion of the medium, the first nozzles and the second nozzles for forming the first image are set to be nozzles which are located further on the downstream side in the given direction than the first nozzles and the second nozzles for forming the first image at the time of the normal image formation.

According to such a fluid ejecting apparatus, a position control range of the medium can be shortened, so that a margin amount of, for example, the upper end portion of the medium can become smaller.

In such a fluid ejecting apparatus, at the time of image formation of a lower end portion of the medium, the control section sets the second nozzles for forming the second image to be nozzles which are located further on the upstream side in the given direction than the second nozzles for forming the second image at the time of the normal image formation.

According to such a fluid ejecting apparatus, the position control range of the medium can be further shortened, so that a margin amount of, for example, the lower end portion of the medium can become smaller.

In such a fluid ejecting apparatus, in a case where the second image is formed by the second fluid and the first fluid, the control section sets, at the time of the normal image formation, the first nozzles for forming the second image to be nozzles which are located further on the downstream side in the given direction than the first nozzles for forming the first image and sets, at the time of the image formation of the lower end portion of the medium, the first nozzles for forming the second image to be nozzles which are located further on the upstream side in the given direction than the first nozzles for forming the second image at the time of the normal image formation.

According to such a fluid ejecting apparatus, color reproducibility of an image can be increased.

Also, according to a third aspect of the invention, there is a fluid ejecting apparatus including: (1) a first nozzle row in which first nozzles that eject first fluid are arranged in a row in a given direction; (2) a second nozzle row in which second nozzles that eject second fluid are arranged in a row in the given direction; (3) a movement mechanism which moves the first nozzle row and the second nozzle row with respect to a medium in a moving direction intersecting the given direction; (4) a transport mechanism which transports the medium with respect to the first nozzle row and the second nozzle row in the given direction; and (5) a control section which repeats an image formation operation for ejecting fluid from the first nozzles and the second nozzles while moving the first nozzle row and the second nozzle row in the moving direction by the movement mechanism and a transport operation for transporting the medium with respect to the first nozzle row and the second nozzle row in the given direction by the transport mechanism, wherein in a case where after the formation of a first image by the first fluid in a certain image formation operation, a second image is formed on the first image by the first fluid and the second fluid in another image formation operation, at the time of normal image formation, the first nozzles and the second nozzles for forming the second image are set to be nozzles which are located further on the downstream side in the given direction than the first nozzles for forming the first image, and at the time of image formation of a lower end portion of the medium, the first nozzles and the second nozzles for forming the second image are set to be nozzles which are located further on the upstream side in the given direction than the first nozzles and the second nozzles for forming the second image at the time of the normal image formation.

According to such a fluid ejecting apparatus, the position control range of the medium can be shortened, so that a margin amount of, for example, the lower end portion of the medium can become smaller.

In such a fluid ejecting apparatus, at the time of image formation of an upper end portion of the medium, the control section sets the first nozzles for forming the first image to be nozzles which are located further on the downstream side in the given direction than the first nozzles for forming the first image at the time of the normal image formation.

According to such a fluid ejecting apparatus, the position control range of the medium can be further shortened, so that a margin amount of, for example, the upper end portion of the medium can become smaller.

Also, according to a third aspect of the invention, there is a fluid ejecting method in which by a fluid ejecting apparatus where an image formation operation for ejecting fluid from first nozzles and second nozzles while moving a first nozzle row, in which the first nozzles that eject first fluid are arranged in a row in a given direction, and a second nozzle row, in which the second nozzles that eject second fluid are arranged in a row in the given direction, in a moving direction intersecting the given direction and a transport operation for transporting a medium with respect to the first nozzle row and the second nozzle row in the given direction are repeated, after the formation of a first image by the first fluid and the second fluid in a certain image formation operation, a second image is formed on the first image by the second fluid in another image formation operation, the method including: ejecting fluid by setting the first nozzles and the second nozzles for forming the first image to be nozzles which are located further on the upstream side in the given direction than the second nozzles for forming the second image, at the time of normal image formation; and ejecting fluid by setting the first nozzles and the second nozzles for forming the first image to be nozzles which are located further on the downstream side in the given direction than the first nozzles and the second nozzles for forming the first image at the time of the normal image formation, at the time of image formation of an upper end portion of the medium.

According to such a fluid ejecting method, the position control range of the medium can be shortened, so that a margin amount of, for example, the upper end portion of the medium can become smaller.

Concerning Printing System

Hereinafter, embodiments will be explained by setting a fluid ejecting apparatus to be an ink jet printer and taking a serial type printer (hereinafter referred to as a printer 1) among the ink jet printers as an example.

Figure 2A:
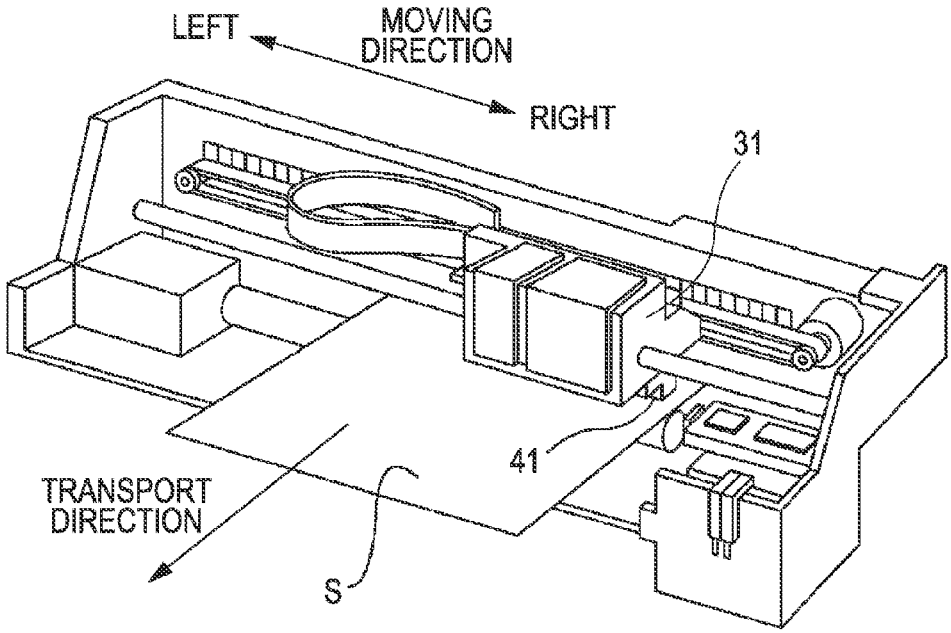
FIG. 2A is a perspective view of the printer and FIG. 2B is a cross-sectional view of the printer.
Figure 2B:
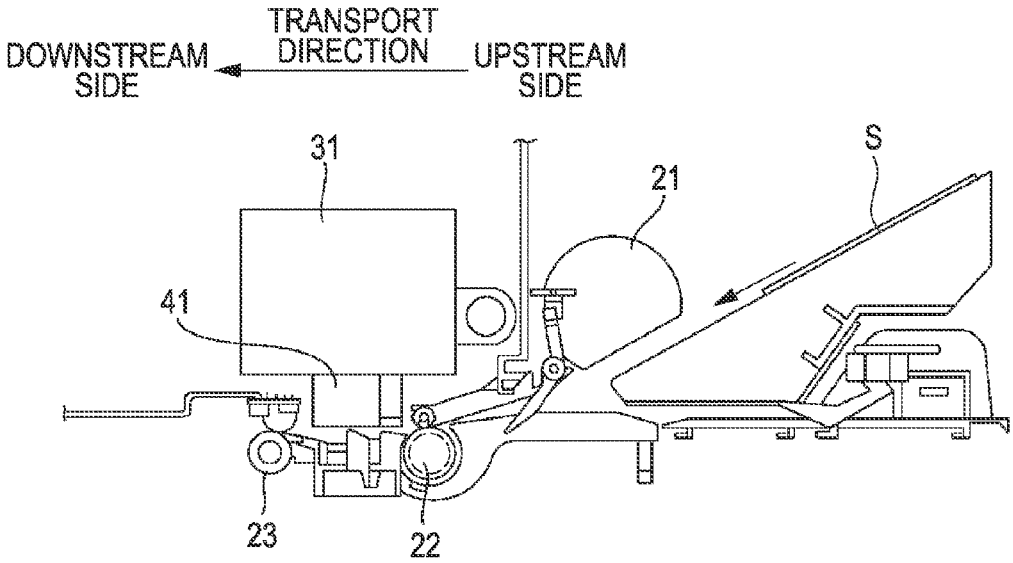

FIG. 1 is a block diagram showing the entire configuration of the printer 1. FIG. 2A is a perspective view of the printer 1 and FIG. 2B is a cross-sectional view of the printer 1. The printer 1 which has received printing data from a computer 60 that is an external device controls each unit (a transport unit 20, a carriage unit 30, and a head unit 40) by a controller 10, thereby forming an image on a medium S (such as paper or film). Also, a detector group 50 monitors the conditions in the printer 1, and on the basis of the detection results thereof, the controller 10 controls each unit.

The controller 10 (a control section) is a control unit for carrying out control of the printer 1. An interface section 11 is for carrying out the transmitting and the receiving of data between the computer 60, which is an external device, and the printer 1. A CPU 12 is an arithmetic processing device for carrying out control of the whole of the printer 1. A memory 13 is for securing an area which stores a program of the CPU 12, a work area, or the like. The CPU 12 controls each unit by a unit control circuit 14 in accordance with the program stored in the memory 13.

The transport unit 20 (a transport mechanism) is to send the medium S to a printable position and transport the medium S at a given transport amount in a transport direction (a given direction) at the time of the printing, and has a paper feed roller 21, a transport roller 22, and a paper discharge roller 23. The paper feed roller 21 is rotated, thereby sending the medium S to be printed up to the transport roller 22. The controller 10 rotates the transport roller 22, thereby positioning the medium S at a print start position.

The carriage unit 30 (a movement mechanism) is for moving a head 41 in a direction (hereinafter referred to as a moving direction) intersecting the transport direction and has a carriage 31.

The head unit 40 is for ejecting ink onto the medium S and has the head 41. The head 41 is moved in the moving direction by the carriage 31. A plurality of nozzles which is an ink ejecting section is provided at the lower face of the head 41, and an ink chamber (not shown) in which ink is contained is provided at each nozzle.

Figure 3:
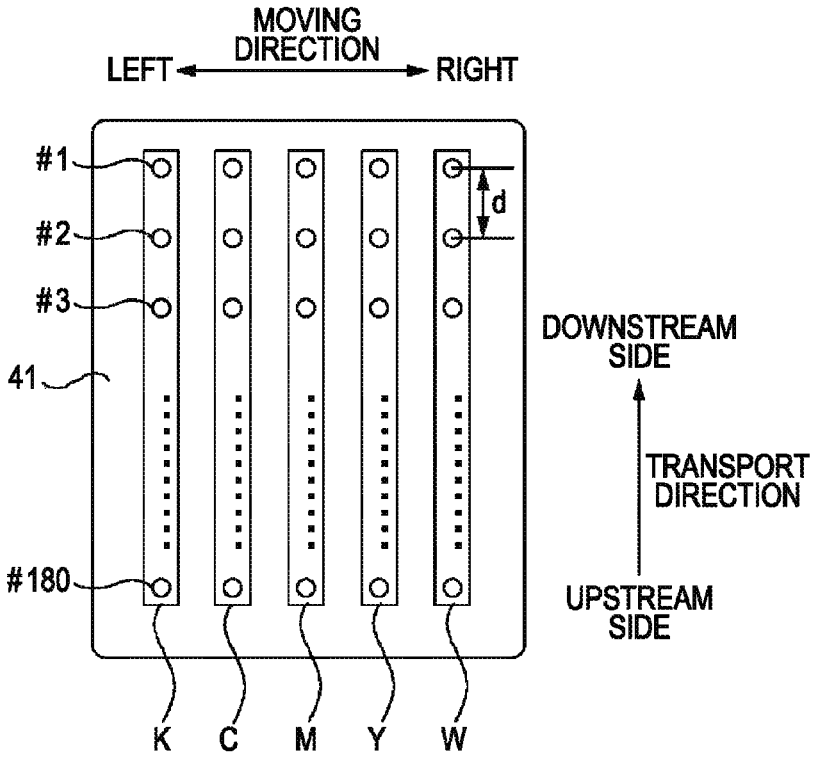
FIG. 3 is a diagram showing a nozzle arrangement of the lower face of a head.

FIG. 3 is a diagram showing a nozzle arrangement of the lower face of the head 41. Five nozzle rows each having 180 nozzles arranged in a row at given intervals (at a nozzle pitch d) in the transport direction are formed at the lower face of the head 41. As shown in the drawing, a black nozzle row K which ejects black ink, a cyan nozzle row C which ejects cyan ink, a magenta nozzle row M which ejects magenta ink, a yellow nozzle row Y which ejects yellow ink, and a white nozzle row W which ejects white ink are arranged in order in the moving direction. In addition, 180 nozzles of each nozzle row are numbered (#1 to #180) in ascending order from the nozzle on the downstream side in the transport direction.

In the printer 1, a dot formation processing for forming a dot on the medium by intermittently ejecting an ink droplet from the head 41 which moves along the moving direction and a transport processing (corresponding to an transport operation) for transporting the medium in the transport direction with respect to the head 41 are repeated. By doing so, it is possible to form a dot at a position on the medium, which is different from a position of the dot formed by the prior dot formation processing, so that a two-dimensional image can be printed on the medium. In addition, an operation (corresponding to single dot-formation processing or an image formation operation) in which the head 41 moves once in the moving direction while ejecting ink droplets is called a "pass".

Concerning Print Mode

In the printer 1 of this embodiment, a "4-color print mode" and a "5-color print mode" can be selected. The "4-color print mode" is a mode in which a color image is directly printed on the medium by the black nozzle row K, the cyan nozzle row C, the magenta nozzle row M, and the yellow nozzle row Y. That is, in the 4-color print mode, ink droplets are ejected from the nozzle rows YMCK of four colors (hereinafter collectively referred to as a "color nozzle row Co") toward the medium. In addition, black-and-white printing is carried out by the 4-color print mode.

On the other hand, the "5-color print mode" is a mode in which a color image is printed on a background image of a white color by ink of four colors (YMCK). That is, the color image is always formed on the background image of a white color. By doing so, even in the case of printing an image on a transparency film, the opposite side of a printed matter can be prevented being transparent. Also, an image which is excellent in a color-producing property can be printed.

Incidentally, if the background image of a white color is formed only by white ink, the color of the background image is determined by the color of the white ink. However, even in ink which is called the same white ink, a color is often different, and there is a case where an image of a desired white color cannot be printed only by white ink.

Therefore, in this embodiment, among a background image of a white color, at a region (hereinafter referred to as an overlapping white region) which overlaps with a color image, a background image is printed only by white ink, and among the background image of a white color, at a region (hereinafter referred to as a non-overlapping white region) which does not overlap with a color image, a background image of a desired white color is printed by appropriately using color ink YMCK of four colors in addition to white ink. By doing so, it is possible to make a portion where the background image of a white color is seen, that is, the non-overlapping white region be a desired white color. In addition, since the overlapping white region is not seen from the printed face side, the region is printed only by white ink. By doing so, the amount of consumed ink can be reduced. However, the printing is not limited thereto, but even at a background image corresponding to the overlapping white region, the printing may also be performed by mixing white ink and color ink.

In addition, in this specification, a "white color" is not limited to a white color in the strict sense, which is a surface color of an object which reflects 100% all the wavelengths of a visible ray, but includes a color called a white color in the generally accepted sense, like so-called "whitish color". In the following explanation, an adjustment of a white color by the mixing of ink of another color to white ink is called "white toning", and a white color (an adjusted white color) produced by the white toning is called "toned white".

Then, in order to print a color image on a background image of toned white, in the 5-color print mode, first, a background image of toned white (corresponding to a first image) is printed on a medium by white ink (corresponding to first fluid) and ink of four colors (YMCK; corresponding to second fluid), and a color image (corresponding to a second image) is then printed on the background image of toned white by ink of four colors (YMCK). In addition, the nozzle which ejects white ink corresponds to a first nozzle, the white nozzle row W corresponds to a first nozzle row, the nozzles which respectively eject ink of 4 colors (YMCK) correspond to a second nozzle, and the color nozzle row Co corresponds to a second nozzle row.

Specifically, in the 5-color print mode, a background image is printed at a certain region on the medium by the white nozzle row W and the color nozzle row Co in the prior pass, and a color image is printed on the background image printed at a certain region on the medium, by the color nozzle row Co in the posterior pass. That is, the nozzles of the color nozzle row Co, which prints the background image, eject ink droplets onto a certain region on the medium in the same pass as that of the white nozzle, and the nozzles of the color nozzle row Co, which prints the color image, eject ink droplets onto a certain region on the medium in a posterior pass different from that of the white nozzle. As a result, it is possible to print a color image after the drying of a background image, so that bleeding of an image can be prevented.

Concerning Transport Unit 20

Figure 4:
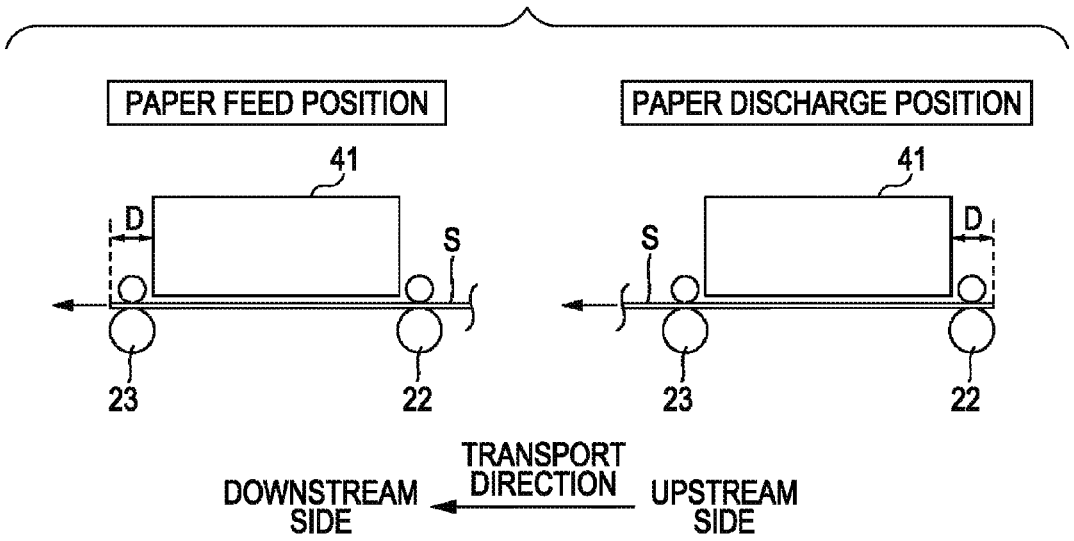
FIG. 4 is a diagram showing a paper feed position and a paper discharge position by a transport unit.

FIG. 4 is a diagram showing a paper feed position and a paper discharge position of the medium S by the transport unit 20 of the printer 1. In the printer 1 of this embodiment, in a state where the medium S has been nipped by both of the transport roller 22 and the paper discharge roller 23, the printing is performed. By doing so, the medium S can be stably transported. In addition, in the following explanation, among two end portions along the moving direction of the medium S, the end portion on the upstream side in the transport direction is called an "upper end portion" and the end portion on the downstream side in the transport direction is called a "lower end portion".

The left drawing of FIG. 4 is a drawing showing a position (a paper feed position of the medium S) of the medium S with respect to the head 41 at the time of the start of the printing. Here, a state where the upper end portion of the medium S is located on the downstream side in the transport direction a length D farther than the end portion on the downstream side in the transport direction of the head 41 is referred to as a "paper feed position (a print start position)". At the shown paper feed position, the printing can be started in a state where the medium S is nipped by the transport roller 22 and the paper discharge roller 23.

On the other hand, the right drawing of FIG. 4 is a drawing showing a position (a paper discharge position of the medium S) of the medium S with respect to the head 41 at the time of the ending of the printing. Here, a state where the lower end portion of the medium S is located on the upstream side in the transport direction a length D farther than the end portion on the upstream side in the transport direction of the head 41 is referred to as a "paper discharge position (a print ending position)". At the shown paper discharge position, the printing can be finished in a state where the medium S is nipped by the transport roller 22 and the paper discharge roller 23.

Concerning Band Printing

4-Color Print Mode

Figure 5:
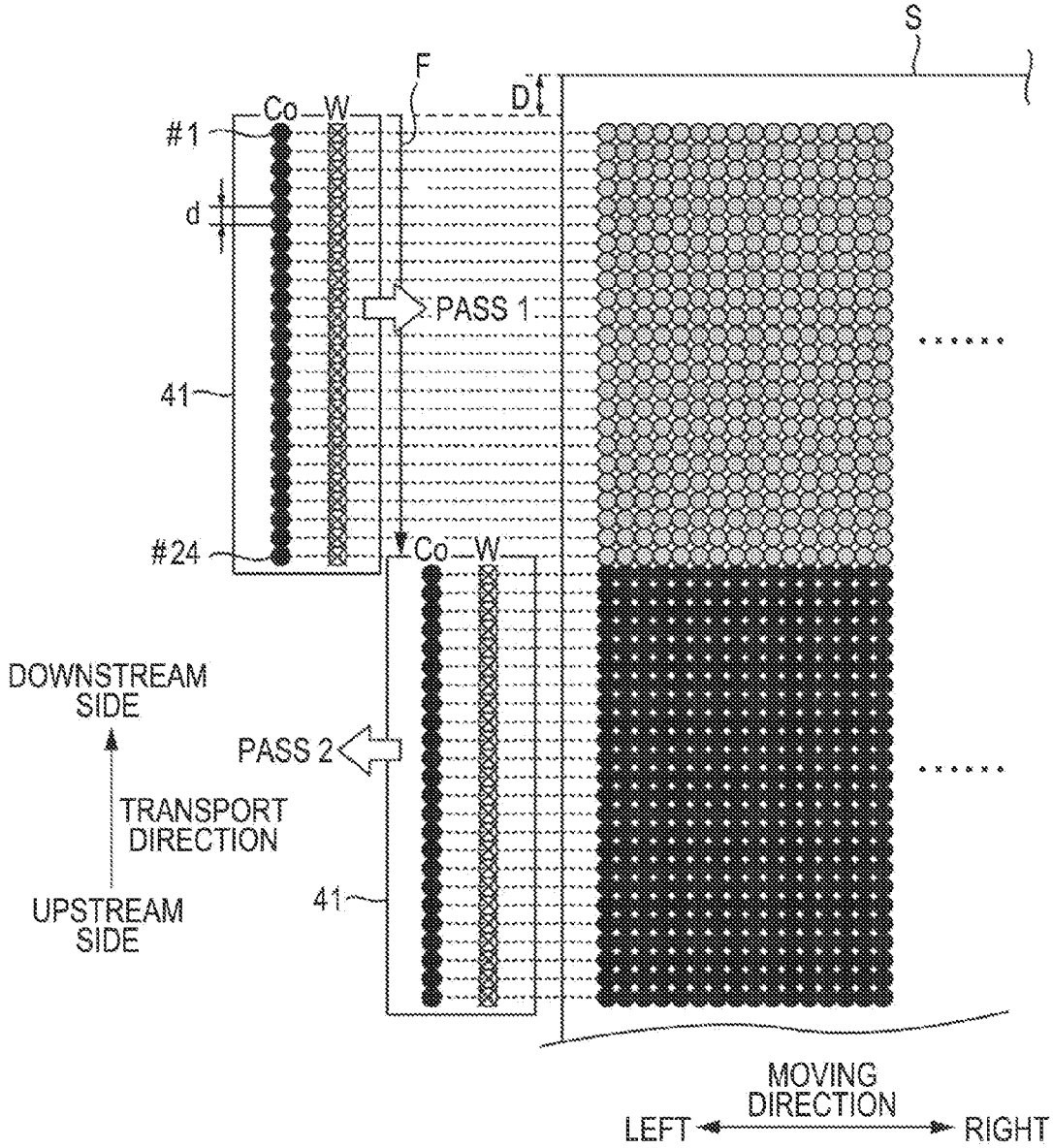
FIG. 5 is a diagram explaining band printing in a 4-color print mode.

FIG. 5 is a diagram explaining band printing in the 4-color print mode. For simplification of explanation, the nozzles of the head 41 are depicted with the number thereof reduced (#1 to #24). Also, the nozzle rows (YMCK) of 4 colors other than the white nozzle row W are collectively depicted as the "color nozzle row Co". In the actual printer 1, the medium S is transported in the transport direction with respect to the head 41. However, in the drawing, the head 41 is depicted to be moved in the transport direction with respect to the medium S.

As shown in FIG. 4, the medium S at the time of the start of the printing is located on the downstream side a length D farther than the end portion on the downstream side in the transport direction of the head 41. Therefore, also in FIG. 5, the medium S is depicted to be located on the downstream side a length D farther than the end portion on the downstream side in the transport direction of the head 41 of Pass 1.

As described above, in the 4-color print mode, a color image is directly printed on the medium S by the nozzle rows (YMCK=the color nozzle row Co) of 4 colors. Therefore, in the 4-color print mode, white ink is not ejected from the white nozzle row W. Also, in the 4-color print mode, all the nozzles belonging to the color nozzle row Co become nozzles usable in the printing (hereinafter referred to as ejection-able nozzles). However, the invention is not limited thereto, but even if it is the 4-color print mode, all the nozzles belonging to the color nozzle row Co need not be set to be the ejection-able nozzles. For example, similarly to the time of a 5-color print mode, which will be described later, the nozzles of a half of the color nozzle row Co may also be set to be the ejection-able nozzles.

Band printing is a printing method in which images (band images) each having a width which is formed by single movement (pass) in the moving direction of the head 41 are arranged in a row in the transport direction, whereby an image is formed. Here, since the number of entire nozzles belonging to the color nozzle row Co is set to be 24, one band image is constituted by 24 raster lines (dot rows along the moving direction). In addition, in FIG. 5, a band image which is formed by first Pass 1 is represented by gray dots, and a band image which is formed by subsequent Pass 2 is represented by black dots.

That is, in the band printing, an operation for forming a band image by ejecting ink droplets from the color nozzle row Co during the movement of the head 41 and an operation for transporting the medium S by the width F of the band image are alternately repeated. Therefore, in the band printing, between the raster lines formed in a certain pass, a raster line is not formed in another pass. That is, in the band printing, the distance between the raster lines corresponds to the nozzle pitch d.

5-Color Print Mode of Comparative Example

Figure 6A:
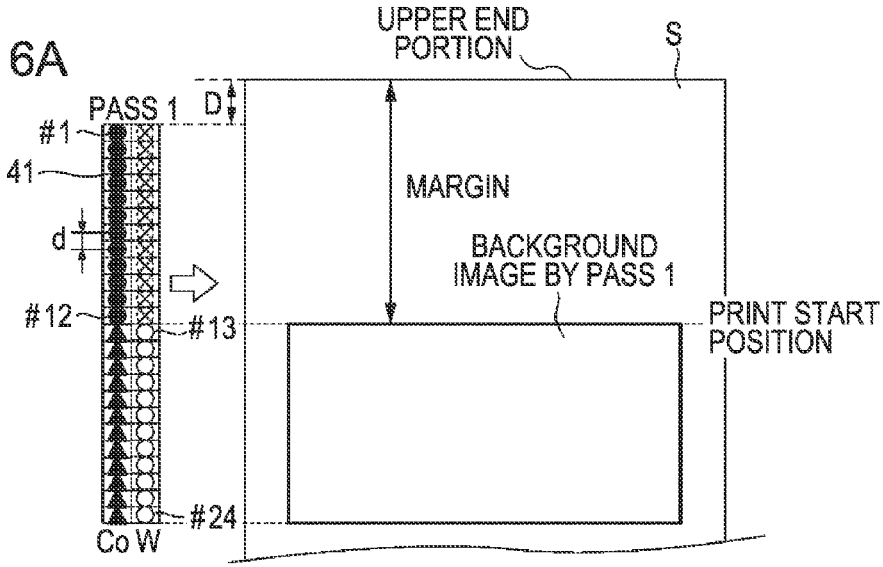
FIGS. 6A and 6B are diagrams showing an aspect in which the upper end portion of a medium is printed by the band printing in a 5-color print mode of a comparative example.
Figure 6B:
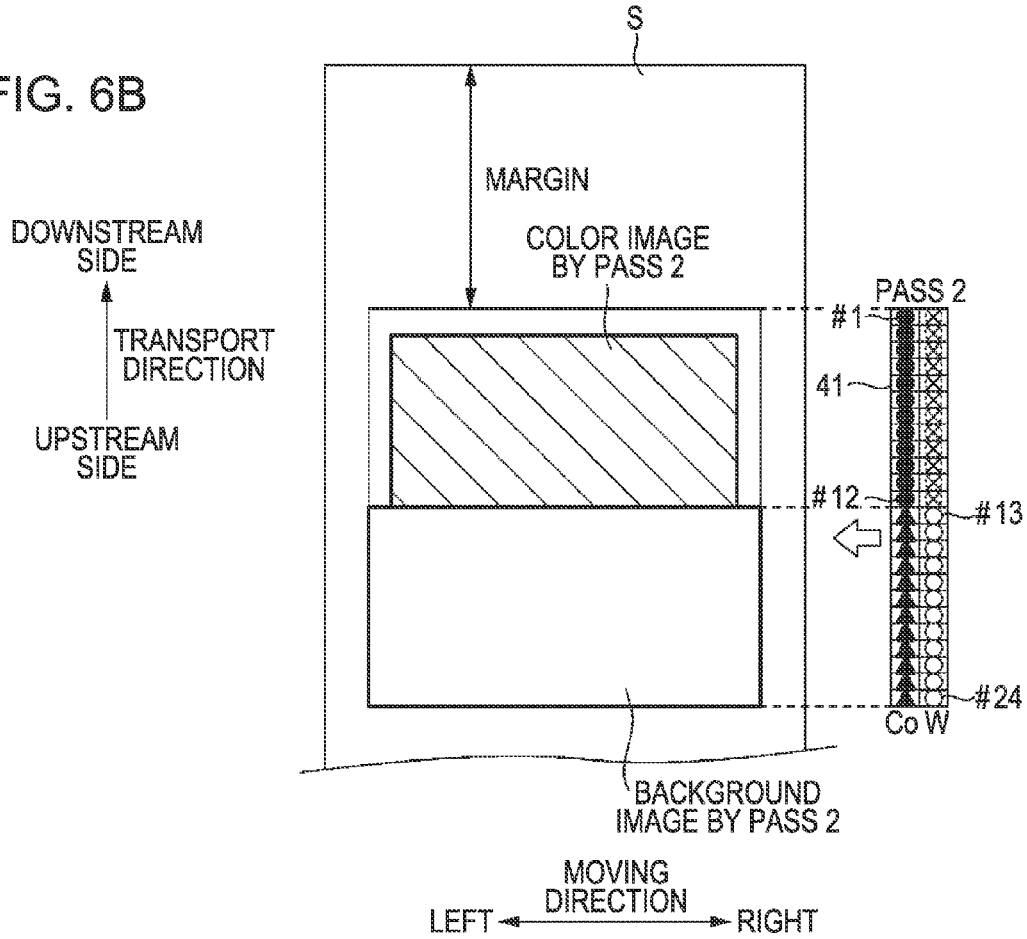
Figure 7A:
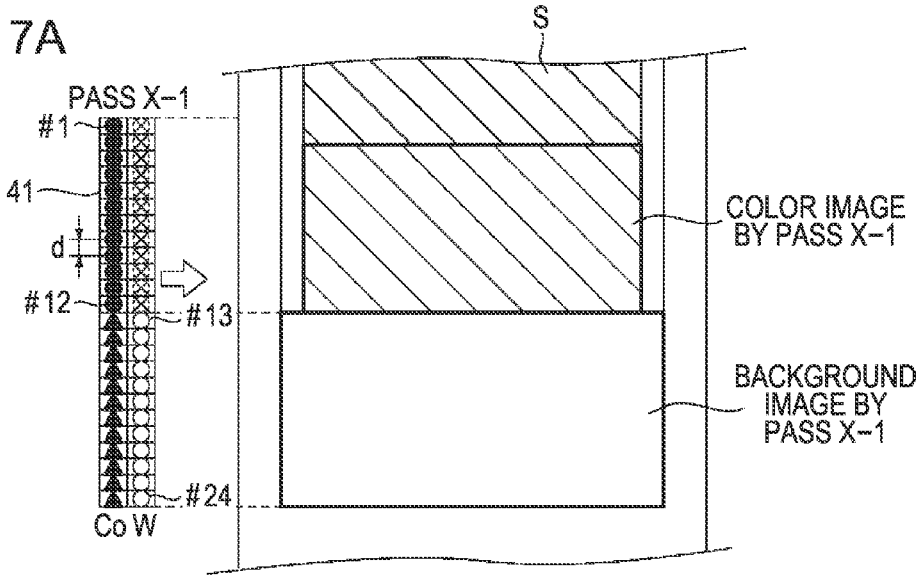
FIGS. 7A and 7B are diagrams showing an aspect in which the lower end portion of the medium is printed by the band printing in the 5-color print mode of the comparative example.
Figure 7B:
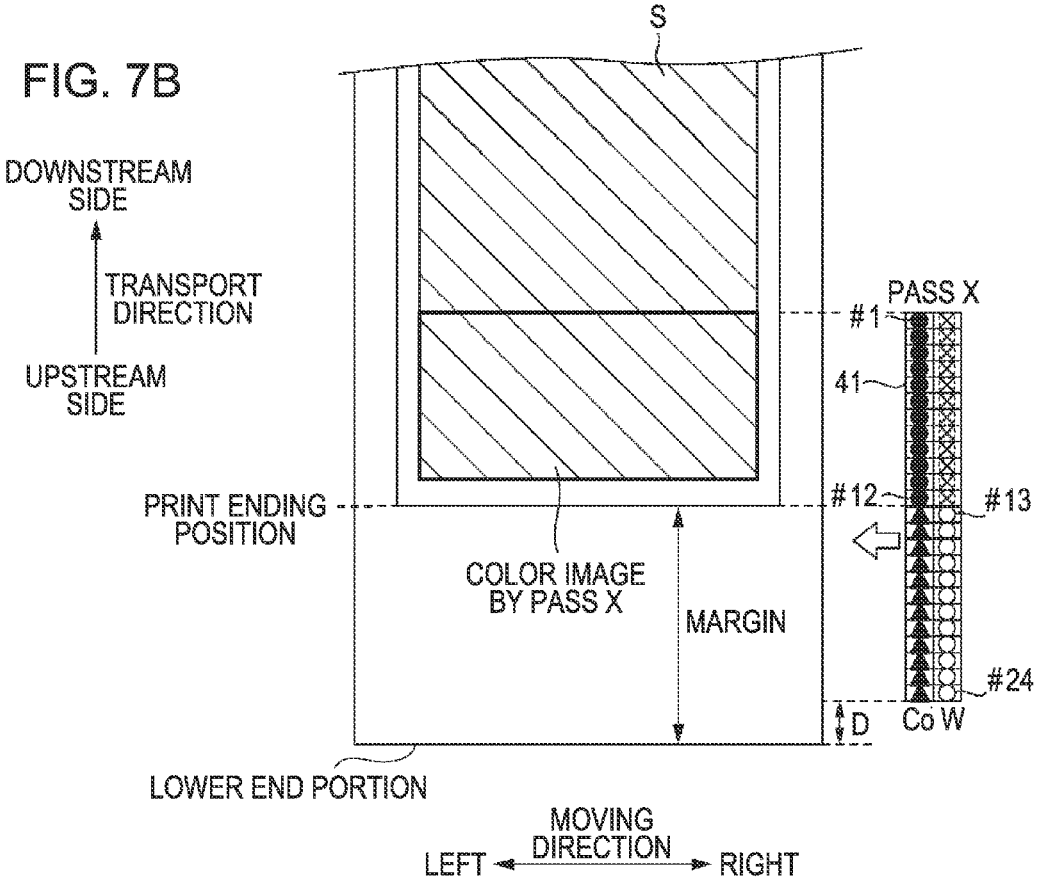

FIGS. 6A and 6B are diagrams showing an aspect in which the upper end portion of the medium S is printed by the band printing in a 5-color print mode of a comparative example, and FIGS. 7A and 7B are diagrams showing an aspect in which the lower end portion of the medium S is printed by the band printing in the 5-color print mode of the comparative example. In addition, the portion (a portion which is first printed) on the upstream side in the transport direction of the medium S is the upper end portion of the medium S, and the portion (a portion which is finally printed) on the downstream side in the transport direction of the medium S is the lower end portion of the medium S. Also, for simplification of explanation, the nozzles of each of the nozzle rows Co and W are depicted with the number thereof reduced (#1 to #24). In the drawings, each nozzle is depicted in a rectangular frame, and the length in the transport direction of one frame corresponds to the nozzle pitch d.

As described above, in the 5-color print mode, after the printing of a background image of toned white by the white nozzle row W and the color nozzle row Co, a color image is printed on the background image by the color nozzle row Co (=YMCK) in a different pass. Thus, in the 5-color print mode of the comparative example, the nozzles (#13 to #24; white circles in the drawing) of a half on the upstream side in the transport direction of the white ink nozzle row W are set to be the nozzles for printing a background image, and similarly, the nozzles (#13 to #24; black triangles in the drawing) of a half on the upstream side in the transport direction of the color nozzle row Co are set to be the nozzles for printing a background image. Then, the nozzles (#1 to #12; black circles in the drawing) of a half on the downstream side in the transport direction of the color nozzle row Co (=YMCK) are set to be the nozzles for printing a color image. In addition, here, from the nozzles (#1 to #12) of a half on the downstream side in the transport direction of the white nozzle row W, white ink is not ejected.

Next, a concrete printing method will be explained. First, as shown in FIG. 6A, at the time of the start of the printing (the paper feed position), a state is made where the upper end portion of the medium S is located on the downstream side in the transport direction a length D farther than the end portion on the downstream side in the transport direction of the head 41 (of Pass 1). Then, in Pass 1, a background image is printed by the nozzles #13 to #24 on the upstream side in the transport direction of the white nozzle row W (white circles) and the color nozzle row Co (black triangles). The background image (a thick line) which is formed by twelve nozzles (#13 to #24) of each of the white nozzle row W and the color nozzle row Co is composed of twelve raster lines.

Next, the medium S is transported by the width (twelve nozzle pitches=12 d) of the background image printed in Pass 1. Then, in Pass 2, a background image (a thick line) is printed by the nozzles #13 to #24 on the upstream side in the transport direction of the white nozzle row W and the color nozzle row Co. As a result, the background image printed in Pass 1 and the background image printed in Pass 2 are arranged in a row in the transport direction. Also, in Pass 2, a color image (an oblique line portion) is printed by the nozzles #1 to #12 on the downstream side in the transport direction of the color nozzle row Co.

Thereafter, an operation for forming a background image by the nozzles #13 to #24 on the upstream side in the transport direction of the white nozzle row W and the color nozzle row Co and forming a color image on the background image formed in the prior pass, by the nozzles #1 to #12 on the downstream side in the transport direction of the color nozzle row Co and an operation for transporting the medium S in the transport direction by twelve nozzles (12 d, 12 frames) are alternately repeated. By doing so, a printed matter with the color image printed on the background image of toned white can be completed.

That is, the nozzles (#13 to #24) which print a background image are set to be nozzles which are located further on the upstream side in the transport direction than the nozzles (#1 to #12) which print a color image. By doing so, with respect to a certain region on the medium S, it is possible to print a background image in the prior pass and print a color image on the background image in the posterior pass.

In such a printing method of the comparative example, as shown in FIG. 6A, the position of the raster line which is formed by the nozzles #13 of the central portions of the white nozzle row W and the color nozzle row Co in a state where the upper end portion of the medium S is located on the downstream side a length D farther than the end portion on the downstream side in the transport direction of the head 41 becomes the print start position. In other words, the summed length of a length D by which the upper end portion of the medium S protrudes with respect to the head 41 at the time of the start of the printing and a length for twelve nozzles (a length for the nozzles which do not print a background image) corresponds to a margin at the upper end portion of the medium S.

On the contrary, in the 4-color print mode shown in FIG. 5, the position of the raster line which is formed by the nozzle #1 on the most downstream side in a state where the upper end portion of the medium S is located on the downstream side a length D farther than the end portion on the downstream side in the transport direction of the head 41 becomes the print start position. Therefore, in the 5-color print mode of the comparative example, compared to the 4-color print mode shown in FIG. 5, a margin amount at the upper end portion of the medium S becomes larger. This is because in the 5-color print mode of the comparative example, the nozzles which first print a background image on the medium are fixed to the nozzles (#13 to #24) of a half on the upstream side in the transport direction. Therefore, the print start position is a position on the upstream side in the transport direction with respect to the head 41.

FIGS. 7A and 7B are diagrams showing an aspect in which the lower end portion of the medium S is printed. As shown in FIG. 7A, in Pass X-1 one before the last, a color image is printed on a background image by the nozzles (#1 to #12) of a half on the downstream side in the transport direction of the color nozzle row Co, and a background image of toned white is printed by the nozzles (#13 to #24) of a half on the upstream side in the transport direction of each of the white nozzle row W and the color nozzle row Co. Thereafter, the medium S is transported by a length (12 d) for twelve nozzles.

Then, in the final Pass X (FIG. 7B), ink is ejected from the nozzles (#1 to #12) on the downstream side in the transport direction of the color nozzle row Co onto the background printed in the prior Pass X-1, and ink is not ejected from the nozzles (#13 to #24) on the upstream side in the transport direction for printing a background image. By doing so, a color image can be printed on all background images, so that the printing is finished.

In the printer 1 of this embodiment, in a state where the lower end portion of the medium S is located on the upstream side a length D farther than the end portion on the upstream side in the transport direction of the head 41 of the final Pass X, the printing is finished. Therefore, the position of the raster line which is formed by the nozzle #12 of the central portion of the color nozzle row Co in a state where the lower end portion of the medium S protrudes to the upstream side a length D farther than the end portion on the upstream side in the transport direction of the head 41 becomes the print ending position. In other words, a length summed up a length D by which the lower end portion of the medium S protrudes with respect to the head 41 at the time of the ending of the printing and a length for twelve nozzles (a length for the nozzles which do not print a color image) corresponds to a margin at the lower end portion of the medium S.

On the contrary, in the 4-color print mode (not shown), the position of the raster line which is formed by the nozzle #24 on the most upstream side in a state where the lower end portion of the medium S is located on the upstream side a length D farther than the end portion on the upstream side in the transport direction of the head 41 becomes the print ending position. Therefore, in the 5-color print mode of the comparative example, compared to the 4-color print mode, a margin amount at the lower end portion of the medium S becomes larger. This is because in the 5-color print mode of the comparative example, the nozzles for printing a color image are fixed to the nozzles (#1 to #12) of a half on the downstream side in the transport direction of the color nozzle row Co. Therefore, the print ending position is a position on the downstream side in the transport direction with respect to the head 41.

In this manner, in the 5-color print mode of the comparative example, the print start position is a position on the upstream side in the transport direction with respect to the head 41, and the print ending position is a position on the downstream side in the transport direction with respect to the head 41. Therefore, a range for controlling a position of the medium S (a length in the transport direction in which position control of the medium S is carried out) during the printing becomes longer.

Therefore, like the printer 1 which is used in this embodiment, in a case where the printing is performed in a state where the medium S is nipped by both the transport roller 22 and the paper discharge roller 23 (FIG. 4), at the time of the start of the printing, as shown in FIG. 6A, a margin amount at the upper end portion of the medium S becomes larger. On the other hand, at the time of the ending of the printing, as shown in FIG. 7B, a margin amount at the lower end portion of the medium S becomes larger. As a result, a size of an image which can be printed on the medium S is reduced or a size of the medium S must be large.

Figure 8A:
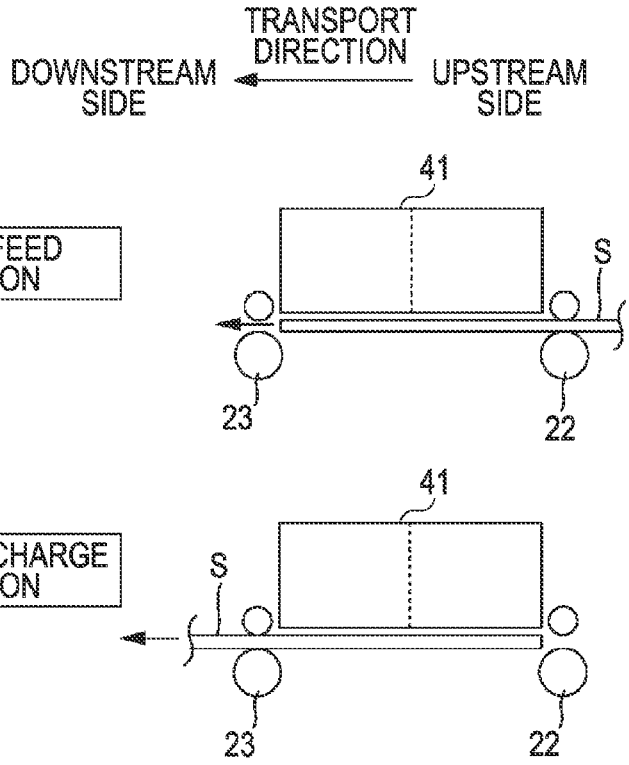
FIGS. 8A and 8B are diagrams showing a paper feed position and a paper discharge position of the medium in a printer having a different transport unit.
Figure 8B:
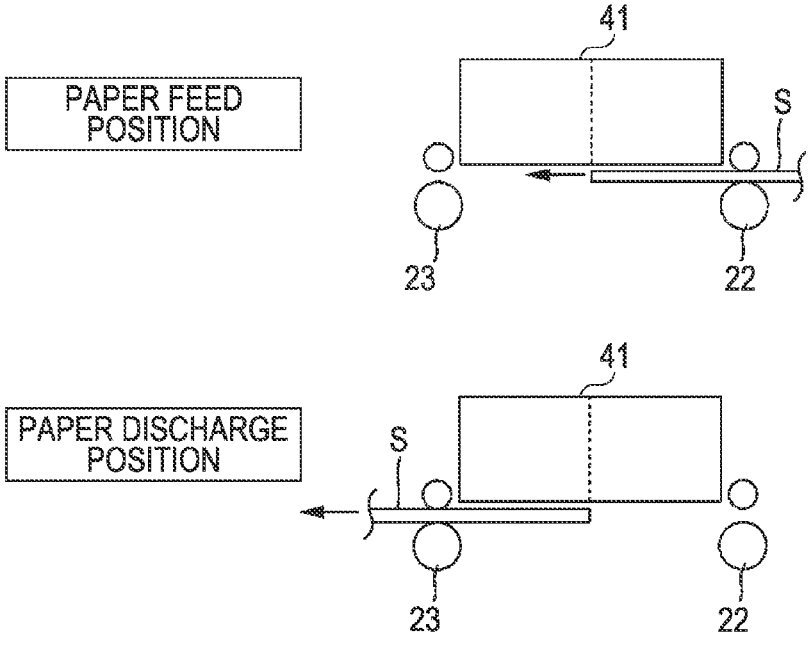

FIGS. 8A and 8B are diagrams showing the paper feed position and the paper discharge position of the medium S in another printer having a different transport unit 20. Besides a printer in which the printing is performed in a state where the medium S is nipped by both the transport roller 22 and the paper discharge roller 23, there is also a printer in which the printing can be performed in a state where the medium S is nipped only by the roller on one side. That is, there is also a printer in which the paper feed position (a head poking position) and the paper discharge position are variable.

In such a printer, for example, in a case where the 4-color print mode is carried out (the case of printing only a color image on the medium), the paper feed position and the paper discharge position of the medium S become the positions shown in FIG. 8A. In the 4-color print mode, since all the nozzles belonging to the color nozzle row Co are used, it is possible to make the upper end portion of the medium S be located on the downstream side in the transport direction with respect to the head 41 at the time of the start of the printing and to make the lower end portion of the medium S be located on the upstream side in the transport direction with respect to the head 41 at the time of the ending of the printing.

On the contrary, in the case of carrying out the 5-color print mode (the band printing) of the comparative example, the paper feed position and the paper discharge position of the medium S become the positions shown in FIG. 8B. In the 5-color print mode of the comparative example, as shown in FIG. 6A, since the nozzles of a half on the upstream side in the transport direction of the white nozzle row W are used, the upper end portion of the medium S is located on the upstream side in the transport direction with respect to the head 41 at the time of the start of the printing. On the other hand, at the time of the ending of the printing, as shown in FIG. 7B, since the nozzles of a half on the downstream side in the transport direction of the color nozzle row Co are used, the lower end portion of the medium S is located on the downstream side in the transport direction with respect to the head 41.

In the case of a printer in which the printing can be performed in a state where the medium S is nipped by one roller of the transport roller 22 and the paper discharge roller 23, also in the 5-color print mode of the comparative example, a margin amount of the medium S can become smaller. However, compared to a case (an example: the 4-color print mode) capable of feeding and discharging the medium S, as shown in FIG. 8A, in the case (the 5-color print mode of the comparative example) of feeding and discharging the medium S, as shown in FIG. 8B, the position control range of the medium S becomes longer. Then, a transport error easily occurs. For example, in the case of controlling the position in the transport direction of the medium S by a rotation amount (transport amount) by the transport roller 22 after the detection of the upper end portion of the medium S by a sensor provided at the upstream side in the transport direction, the longer a transport control range, the more easily the transport error occurs.

Also, as shown in FIG. 8B, in a case where the paper feed position is located on the upstream side in the transport direction with respect to the head 41, the protrusion amount of the medium S to the upstream side in the transport direction with respect to the head 41 becomes larger. Similarly, in a case where the paper discharge position is located on the downstream side in the transport direction with respect to the head 41, the protrusion amount of the medium S to the downstream side in the transport direction with respect to the head 41 becomes larger. Therefore, a size of the transport unit 20 becomes larger or jamming of the medium S is easily generated.

In this manner, in the 5-color print mode of the comparative example, the print start position is a position on the upstream side in the transport direction with respect to the head 41, and the print ending position is a position on the downstream side in the transport direction with respect to the head 41. That is, the position control range of the medium S becomes longer. As a result, the transport error easily occurs, a margin of the medium S becomes larger, or the protrusion amount of the medium S from the head 41 is larger, whereby a size of the transport unit 20 becomes larger.

Therefore, in this embodiment, an object is to make the position control range of the medium S as short as possible in the case (the 5-color print mode) of printing a color image on a background image. In other words, in this embodiment, an object is to make the print start position be on the downstream side in the transport direction as much as possible and make the print ending position be on the upstream side in the transport direction as much as possible.

5-Color Print Mode of this Embodiment

Figure 9:
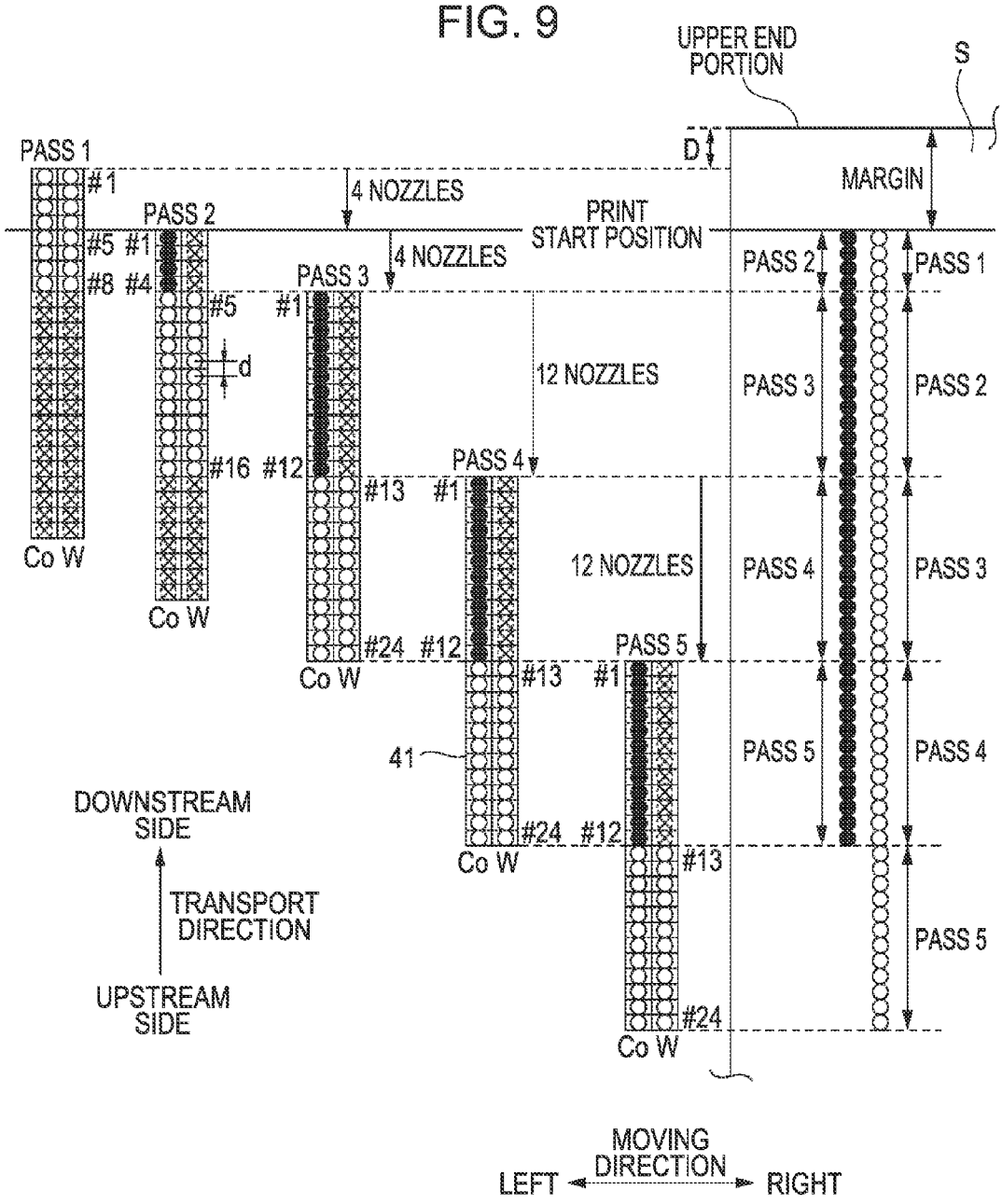
FIG. 9 is a diagram showing an aspect in which the upper end portion of the medium is printed in the band printing in a 5-color print mode of an embodiment of the invention.
Figure 10:
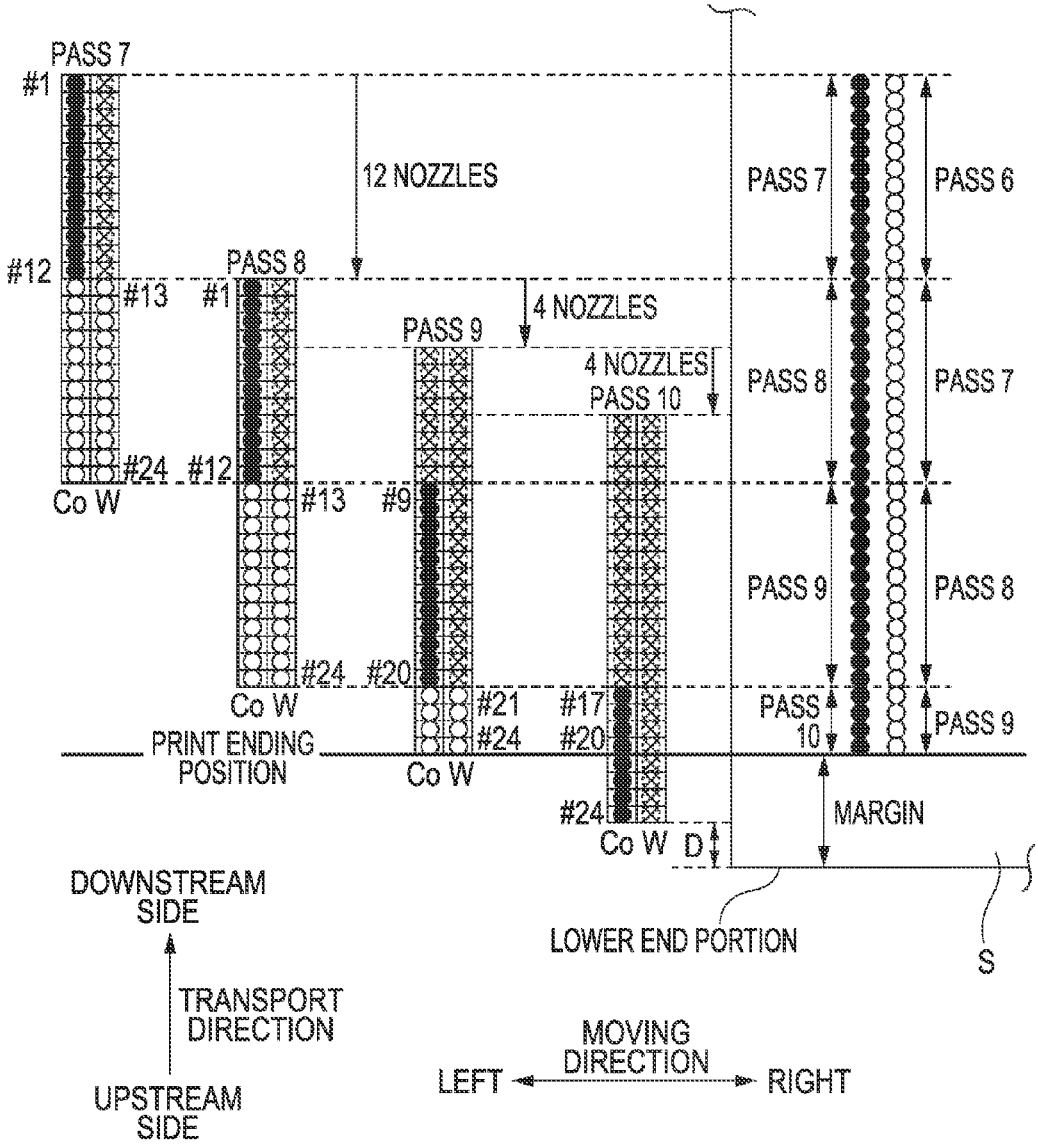
FIG. 10 is a diagram showing an aspect in which the lower end portion of the medium is printed in the band printing in the 5-color print mode of the embodiment.

FIG. 9 is a diagram showing an aspect in which the upper end portion of the medium S is printed in the band printing in the 5-color print mode of this embodiment, and FIG. 10 is a diagram showing an aspect in which the lower end portion of the medium S is printed in the band printing in the 5-color print mode of this embodiment. For simplification of explanation, the nozzles of each of the nozzle rows Co and W are depicted with the number thereof reduced to 24. In the color nozzle row Co, the nozzle capable of ejecting ink in order to print a color image is represented by a black circle and the nozzle capable of ejecting ink in order to print a background image of toned white is represented by a white circle. Also, in the white nozzle row W, the nozzle capable of ejecting ink in order to print a background image of toned white is represented by a white circle.

In the 5-color print mode of the comparative example described above (FIGS. 6A to 7B), the nozzles which print a background image of toned white are fixed to the nozzles (#13 to #24) of a half on the upstream side in the transport direction of each of the white nozzle row W and the color nozzle row Co, and the nozzles which print a color image are fixed to the nozzles (#1 to #12) of a half on the downstream side in the transport direction of the color nozzle row Co.

On the contrary, in the 5-color print mode of this embodiment, the nozzles on the downstream side in the transport direction of the white nozzle row W and the color nozzle row Co are also used for the printing of a background image of toned white. Similarly, the nozzles on the upstream side in the transport direction of the color nozzle row Co are also used for the printing of a color image.

First, the printing of the upper end portion of the medium S is specifically explained. As shown in FIG. 9, the paper feed position at the time of the start of the printing is a position where the upper end portion of the medium S is shifted to the downstream side in the transport direction a length D farther than the end portion on the downstream side in the transport direction of the head 41 of Pass 1. Then, in this embodiment, in Pass 1, eight nozzles (#1 to #8) on the downstream side of the white nozzle row W and the color nozzle row Co are set to be the ejection-able nozzles (the nozzles usable in the printing). However, since the medium S is transported by four nozzles (4 d, 4 frames) after Pass 1, in Pass 1, a background image is printed by ejecting ink droplets from four nozzles (#5 to #8) on the upstream side in the transport direction among the ejection-able nozzles (#1 to #8).

In subsequent Pass 2, ink droplets are ejected from four nozzles #1 to #4 on the downstream side in the transport direction of the color nozzle row Co in order to print a color image. A medium position facing the nozzles #1 to #4 of the color nozzle row Co of Pass 2 and a medium position facing the nozzles #5 to #8 of the white nozzle row W and the color nozzle row Co of the previous Pass 1 are the same. Therefore, on the background image printed by Pass 1, a color image can be printed in Pass 2. Also, in Pass 2, a background image is printed by twelve nozzles #5 to #16 of each of the white nozzle row W and the color nozzle row Co. Thereafter, the medium S is transported by four nozzles.

In Pass 3, ink droplets are ejected from the nozzles (#1 to #12) of a half on the downstream side in the transport direction of the color nozzle row Co in order to print a color image, and ink droplets are ejected from the nozzles (#13 to #24) of a half on the upstream side in the transport direction of each of the white nozzle row W and the color nozzle row Co in order to print a background image. Since a medium position facing the nozzles #1 to #12 of the color nozzle row Co of Pass 3 and a medium position facing the nozzles #5 to #16 of the white nozzle row W and the color nozzle row Co of Pass 2 are the same, on the background image printed in Pass 2, a color image can be printed in Pass 3. Thereafter, the medium S is transported by twelve nozzles to the downstream side in the transport direction.

Thereafter (Pass 4 and after it), an operation for printing a color image by the nozzles (#1 to #12) of a half on the downstream side in the transport direction of the color nozzle row Co and printing a background image by the nozzles (#13 to #24) of a half on the upstream side in the transport direction of each of the white nozzle row W and the color nozzle row Co and an operation for transporting the medium S by twelve nozzles are alternately repeated. By doing so, on the background image formed in the previous pass, a color image can be printed in the subsequent pass.

In this manner, the printing which is performed by changing the number of nozzles used, the positions of the nozzles, or a transport amount of the medium in order to form dots on the upper end portion (the portion on the downstream side in the transport direction) of the medium S in the same way as that in a normal portion (the central portion) of the medium S is called "upper end printing". On the other hand, the printing which is performed in a state where the number of nozzles used, the positions of the nozzles, or a transport amount of the medium is constant is called "normal printing". Here, a pass in which the number of nozzles used or the positions of the nozzles are different from those in the normal printing is set to be the upper end printing, and in a case where a transport amount of the medium after a certain pass is different from that in the normal printing, the pass is set to be the upper end printing. Therefore, in FIG. 9, an operation from Pass 1 to a transport operation after Pass 2 corresponds to the upper end printing (the time of the image formation of the upper end portion of the medium), and an operation in Pass 3 and after it corresponds to the normal printing (the time of normal image formation).

Summarizing the aforesaid, at the time of the normal printing of this embodiment, the nozzles for printing a background image of toned white are set to be the nozzles (#13 to #24) of a half on the upstream side in the transport direction of each of the white nozzle row W and the color nozzle row Co, and the nozzles for printing a color image are set to be the nozzles (#1 to #12) of a half on the downstream side in the transport direction of the color nozzle row Co. In addition, the setting of the number of nozzles which print each of a background image and a color image at the time of the normal printing is not limited to the number of nozzles (in the drawing, 12) of a half of the nozzle row. By making at least the nozzles for printing a background image be located further on the upstream side in the transport direction than the nozzles for printing a color image, it is possible to print a color image on a background image in a pass after the pass in which the background image has been printed.

Then, at the time of the upper end printing of this embodiment, a background image is printed by using the nozzles different from the nozzles (#13 to #24) which print a background image at the time of the normal printing. Additionally speaking, the nozzles which print a background image at the time of the upper end printing of this embodiment are set to be nozzles which are located further on the downstream side in the transport direction than the nozzles which print a background image at the time of the normal printing.

As a result, in the comparative example (FIG. 6A), the position of the raster line which is formed by the nozzle #13 of the head 41 of Pass 1 is the print start position, whereas in this embodiment, as shown in FIG. 9, the position of the raster line which is formed by the nozzle #5 of the head 41 of Pass 1 is the print start position (a thick line). Therefore, in this embodiment, it is possible to make the print start position be further on the downstream side in the transport direction than that in the comparative example, so that the position control range of the medium S can be shortened. As a result, a margin amount of the medium S can become smaller. Specifically, in the comparative example, the total amount of the protrusion amount D of the upper end portion of the medium from the head 41 at the time of the start of the printing and a length for twelve nozzles becomes a margin, whereas in this embodiment, the total amount of the protrusion amount D of the upper end portion of the medium from the head 41 at the time of the start of the printing and a length for four nozzles becomes a margin.

Also, in the case of the printer in which the paper feed position (head poking position) of the medium S is variable, in the upper end printing of this embodiment, since it is possible to make the print start position be on the downstream side in the transport direction with respect to the head 41, it is possible to start the printing at the paper feed position shown in FIG. 8A. Also from this, it can be found that in this embodiment, compared to the comparative example (FIG. 8B), the position control range of the medium S is shortened.

Also, in the comparative example (FIGS. 6A and 6B), the nozzles for printing a background image are fixed to the nozzles (#13 to #24) of a half on the upstream side in the transport direction of the white nozzle row W. Therefore, in the comparative example, from the nozzles (#1 to #12) of a half on the downstream side in the transport direction of the white nozzle row W, ink droplets are not ejected. Hence, there is a fear that in the nozzles (#1 to #12) of a half on the downstream side in the transport direction of the white nozzle row W, thickening of ink progresses, thereby generating an ejection defect. On the contrary, in this embodiment, in order to print a background image, not only the nozzles of a half on the upstream side in the transport direction of the white nozzle row W, but also the nozzles on the downstream side in the transport direction are used. Therefore, thickening of ink in the nozzles on the downstream side in the transport direction of the white nozzle row W can be prevented. That is, in this embodiment, compared to the comparative example, since not only the nozzles on the upstream side of the white nozzle row W, but also the nozzles on the downstream side are used, thickening of ink can be prevented.

Also, in the case of using only the nozzles on the upstream side of the white nozzle row W like the comparative example, if a nozzle which generates an ejection defect exists in the nozzles on the upstream side, the printing is severely affected by the nozzle which generates an ejection defect. On the contrary, as in this embodiment, by using not only the nozzles on the upstream side, but also the nozzles on the downstream side, thereby using many kinds of nozzles, a difference in characteristic between nozzles can be alleviated.

Next, the printing of the lower end portion of the medium S will be specifically explained by using FIG. 10. In addition, in FIG. 10, the printing is set to be finished in Pass 10. An operation up to Pass 7 is the normal printing (the time of the normal image formation), and an operation for printing a color image by the nozzles (#1 to #12) of a half on the downstream side in the transport direction of the color nozzle row Co and printing a background image of toned white by the nozzles (#13 to #24) of a half on the upstream side in the transport direction of each of the white nozzle row W and the color nozzle row Co and an operation for transporting the medium S by twelve nozzles are repeated.

In Pass 8, after the formation of a color image by the nozzles of a half on the downstream side in the transport direction of the color nozzle row Co and the formation of a background image by the nozzles of a half on the upstream side in the transport direction of each of the white nozzle row W and the color nozzle row Co, the medium S is transported by four nozzles. Then, in Pass 9, a color image is printed by twelve nozzles #9 to #20 of the color nozzle row Co, and a background image is printed by four nozzles #21 to #24 on the upstream side of each of the white nozzle row W and the color nozzle row Co. A medium position facing the nozzles #9 to #20 of the color nozzle row Co of Pass 9 and a medium position facing the nozzles #13 to #24 of the white nozzle row W and the color nozzle row Co of the previous Pass 8 are the same. Therefore, on the background image printed in Pass 8, a color image can be printed in Pass 9. Thereafter, the medium S is transported by four nozzles.

In Pass 10, in order to print a color image, eight nozzles (#17 to #24) on the upstream side in the transport direction of the color nozzle row Co are set to the ejection-able nozzles. However, in the previous Pass 9, a background image is printed by four nozzles (#21 to #24) of each of the white nozzle row W and the color nozzle row Co. Therefore, in order to print a color image in Pass 10, ink is ejected from four nozzles (#17 to #20) on the downstream side in the transport direction among eight ejection-able nozzles (#17 to #24) of the color nozzle row Co. As a result, on the background image formed in Pass 9, a color image can be printed in Pass 10. Also, in Pass 10, from the white nozzle row W, ink droplets are not ejected.

In this manner, in order to form dots on the lower end portion of the medium S in the same way as that in the upper end portion or the normal portion of the medium, the printing is carried out by changing the number of nozzles used, the positions of the nozzles, or a transport amount of the medium. This is called "lower end printing". Here, a pass in which the number of nozzles used or the positions of the nozzles are different from those in the normal printing is set to be the lower end printing, and in a case where a transport amount of the medium after a certain pass is different from that in the normal printing, the pass is set to be the lower end printing. Therefore, in FIG. 10, an operation up to Pass 7 corresponds to the normal printing, and an operation from Pass 8 to Pass 10 corresponds to the lower end printing (the time of the image formation of the lower end portion of the medium).

Summarizing the aforesaid, at the time of the lower end printing of this embodiment, a color image is printed by using the nozzles different from the nozzles (#1 to #12) of the color nozzle row Co, which print a color image at the time of the normal printing. Additionally speaking, the nozzles which print a color image at the time of the lower end printing of this embodiment are set to be nozzles which are located further on the upstream side in the transport direction than the nozzles which print a color image at the time of the normal printing.

As a result, in the comparative example (FIG. 7B), the position of the raster line which is formed by the nozzle #12 of the head 41 of final Pass X becomes the print ending position, whereas in this embodiment, as shown in FIG. 10, the position of the raster line which is formed by the nozzle #20 of the head 41 of final Pass 10 becomes the print ending position (a thick line). Therefore, in this embodiment, it is possible to make the print ending position be further on the upstream side in the transport direction than that in the comparative example, so that the position control range of the medium S can be shortened. As a result, a margin amount of the medium S can become smaller. Specifically, in the comparative example, the total amount of the protrusion amount D of the lower end portion of the medium from the head 41 at the time of the ending of the printing and a length for twelve nozzles becomes a margin, whereas in this embodiment, the total amount of the protrusion amount D of the lower end portion of the medium from the head 41 at the time of the ending of the printing and a length for four nozzles becomes a margin.

Also, in the case of a printer in which the paper discharge position of the medium S is variable, in the lower end printing of this embodiment, since it is possible to make the print ending position be on the upstream side in the transport direction with respect to the head 41, the printing can be finished at the paper discharge position shown in FIG. 8A. Also from this, it can be found that in this embodiment, compared to the comparative example (FIG. 8B), the position control range of the medium is shortened.

That is, in the 5-color print mode of this embodiment, at the time of the normal printing, the nozzles which print a background image are set to be the nozzles on the upstream side in the transport direction and the nozzles which print a color image are set to be the nozzles on the downstream side in the transport direction. However, at the time of the upper end printing and the time of the lower end printing, the nozzles which print a background image and a color image are set to be different. At the time of the upper end printing, compared to the time of the normal printing, by setting the nozzles for printing a background image to be the nozzles on the downstream side in the transport direction, the print start position is made to be on the downstream side in the transport direction. Also, at the time of the lower end printing, compared to the time of the normal printing, by setting the nozzles for printing a color image to be the nozzles on the upstream side in the transport direction, it is possible to make the print ending position be on the upstream side in the transport direction. As a result, the position control range of the medium can be shortened, so that it is possible to make it difficult for a transport error to be generated or to reduce a margin amount. Also, since not only some nozzles, but more kinds of nozzles are used, thickening of ink or a difference in characteristic between nozzles can be alleviated.

In addition, in a case where the controller 10 in the printer 1 assigns data for printing the upper end portion of the medium to the nozzles on the downstream side in the transport direction of the white nozzle row W and the color nozzle row Co, the controller 10 corresponds to the control section and a single body of the printer 1 corresponds to the fluid ejecting apparatus. However, the invention is not limited thereto, but in a case where a printer driver in the computer 60 connected to the printer 1 assigns data for printing the upper end portion of the medium to the nozzles on the downstream side in the transport direction of the white nozzle row W and the color nozzle row Co, the computer 60 and the controller 10 of the printer 1 correspond to the control section and a printing system in which the computer 60 and the printer 1 are connected to each other corresponds to the fluid ejecting apparatus.

In addition, as shown in FIG. 9, at the time of the upper end printing, the ejection-able nozzles (white circles) of the white nozzle row W and the color nozzle row Co for printing a background image of toned white are shifted to the upstream side in the transport direction in accordance with the progress of the printing. Specifically, in Pass 1, the nozzles #1 to #8 of the white nozzle row W and the color nozzle row Co are the ejection-able nozzles, in Pass 2, the nozzles #5 to #16 of the white nozzle row W and the color nozzle row Co are the ejection-able nozzles, and finally (Pass 3 and after it), the nozzles #13 to #24 of a half on the upstream side in the transport direction of each of the white nozzle row W and the color nozzle row Co become the ejection-able nozzles. Also, at the time of the upper end printing, in accordance with the transition of the nozzles for printing a background image to the upstream side in the transport direction, the ejection-able nozzles (black circles) of the color nozzle row Co for printing a color image are also increased to the upstream side in the transport direction. By doing so, the transition from the upper end printing to the normal printing is possible, so that on the background image printed in the prior pass, a color image can be printed in the posterior pass.

Also, in this embodiment, at the time of the upper end printing, by gradually shifting the ejection-able nozzles (white circles) for printing a background image to the upstream side in the transport direction, the time after the printing of a background image and until the printing of a color image thereon is made to be the same as that at the time of the normal printing. At the time of the normal printing, a background image is printed in the previous pass and a color image is printed on the background image in the subsequent pass.

For example, in Pass 1, in order to print a background image, the nozzles up to the nozzle #8 are set to be the ejection-able nozzles. However, in Pass 1, it is also possible to print a background image by the nozzles (#9 to #24) further on the downstream side than it. However, if a background image is also printed by the nozzle #9 and the nozzles on the downstream side thereof in Pass 1, it is not necessary to print a background image by the nozzles #5 to #16 in Pass 2, so that on the background image formed by the nozzle #9 and the nozzles on the downstream side thereof in Pass 1, a color image is printed in Pass 3 which is the normal printing. In this case, since a color image is printed with one pass skipped after the printing of a background image, the time after the printing of a background image and until the printing of a color image becomes different at the time of the upper end printing and the time of the normal printing. In this manner, if there is a variation in the time after the printing of a background image and until the printing of a color image, the drying time of the background image varies, so that the drying state of the background image (the bleeding state of the color image) when printing the color image varies. As a result, density unevenness of an image is generated. Therefore, in this embodiment, the time after the printing of a background image and until the printing of a color image is set to be constant.

Therefore, it is preferable to perform the upper end printing by a printing method which is as close to that at the time of the normal printing as possible. At the time of the normal printing, an operation for ejecting ink droplets from fixed twelve nozzles (#13 to #24) on the upstream side in the transport direction for printing a background image and an operation for transporting the medium S by twelve nozzles are repeated. That is, a positional relationship between the ejection-able nozzles (#13 to #24) for a background image and the medium is shifted to the transport direction by twelve nozzles for every pass. Therefore, at the time of the upper end printing, a transport amount of the medium S after Pass 1 is set to be four nozzles, and the ejection-able nozzle (for example, #16) for a background image of Pass 2 is shifted by eight nozzles from the ejection-able nozzle (for example, #8) for a background image of Pass 1. Similarly, a transport amount of the medium S after Pass 2 is set to be four nozzles, and the ejection-able nozzle (for example, #24) for a background image of Pass 3 is shifted by eight nozzles from the ejection-able nozzle (for example, #16) for a background image of Pass 2. By doing so, also at the time of the upper end printing, similarly to the time of the normal printing, a positional relationship between the ejection-able nozzles for a background image and the medium is shifted to the transport direction by twelve nozzles for every pass. That is, the total amount of a shift amount of the ejection-able nozzle to the upstream side in the transport direction for every pass at the time of the upper end printing (the first nozzle for forming the first image) and a transport amount of the medium S at the time of the upper end printing is made to be the same as a transport amount of the medium S at the time of the normal printing. Further, in this embodiment, by making a shift amount of the ejection-able nozzle to the upstream side in the transport direction at the time of the upper end printing constant, the nozzles on the downstream side in the transport direction of the white nozzle row W, which are not used in the printing of a color image, can be averagely used. Also, by making a shift amount of the ejection-able nozzle to the upstream side in the transport direction at the time of the upper end printing constant, a transport amount of the medium S becomes constant. As a result, the transport operation can be stabilized, so that printing control can be easily performed.

Similarly, also at the time of the lower end printing, as shown in FIG. 10, the ejection-able nozzles (black circles) of the color nozzle row Co for printing a color image are shifted to the upstream side in the transport direction in accordance with the progress of the printing. Specifically, in Pass 8, the nozzles #1 to #12 of the color nozzle row are the ejection-able nozzles for a color image, in Pass 9, the nozzles #9 to #20 of the color nozzle row Co are the ejection-able nozzles for a color image, and in Pass 10, the nozzles #17 to #24 of the color nozzle row Co become the ejection-able nozzles for a color image. Also, at the time of the lower end printing, in accordance with the transition of the ejection-able nozzles (black circles) of the color nozzle row Co for printing a color image to the upstream side in the transport direction, the ejection-able nozzles (white circles) of the white nozzle row W and the color nozzle row Co for printing a background image are reduced to the upstream side in the transport direction. By doing so, the transition from the normal printing to the lower end printing is possible, so that on a background image printed in the prior pass, a color image can be printed in the posterior pass.

Also in the lower end printing, the total amount of a shift amount of the ejection-able nozzle for a color image to the upstream side in the transport direction and a transport amount of the medium S is made to be the same as a transport amount of the medium S at the time of the normal printing. For example, a transport amount of the medium S after Pass 8 is set to be four nozzles, and the ejection-able nozzle (for example, #20) for a color image of Pass 9 is shifted by eight nozzles from the ejection-able nozzle (for example, #12) for a color image of Pass 8. By doing so, also at the time of the lower end printing, a positional relationship between the ejection-able nozzles for a color image and the medium is shifted to the transport direction by twelve nozzles for every pass. By doing so, also at the time of the lower end printing, similarly to the time of the normal printing, it is possible to print a color image in the pass following the pass in which a background image is printed. As a result, the time after the printing of a background image and until the printing of a color image can become constant at the time of the normal printing and the time of the lower end printing, so that density unevenness of an image can be suppressed. Also, at the time of the lower end printing, by making a shift amount of the ejection-able nozzle for a color image to the upstream side in the transport direction constant, a transport amount of the medium S becomes constant. As a result, a transport operation can be stabilized, so that printing control can be easily performed.

However, not only by making the total amount of a shift amount of the ejection-able nozzle to the upstream side in the transport direction at the time of the upper end printing (or the time of the lower end printing) and a transport amount of the medium S be the same as a transport amount of the medium S at the time of the normal printing, but by making the time after the printing of a background image and until the printing of a color image be the same as that at the time of the upper end printing (or the time of the lower end printing) and the time of the normal printing density unevenness of an image can be prevented.

Concerning Overlap Printing

Next, the upper end printing and the lower end printing in the case of performing "overlap printing" in the 5-color print mode (a mode in which a color image is printed on a background image of toned white) will be explained. The overlap printing is a printing method in which one raster line (a dot row along the moving direction) is formed by a plurality of nozzles. According to the overlap printing, even if there is a nozzle which generates an ejection defect or a nozzle in which the ejected ink carries out a curved flight due to a manufacturing error or the like, since one raster line is formed by a plurality of nozzles, a difference in characteristic between nozzles can be alleviated. As a result, deterioration of an image quality can be suppressed. In the following explanation, the overlap printing in which one raster line is formed by two nozzles will be taken and explained as an example. Also, the raster lines are printed to be arranged in the transport direction at intervals narrower than the nozzle pitch d. In addition, although the 4-color print mode (a mode in which a color image is directly printed on a medium) is not explained in detail, the overlap printing is performed by using the whole of the color nozzle row Co.

5-Color Print Mode of Comparative Example

Figure 11:
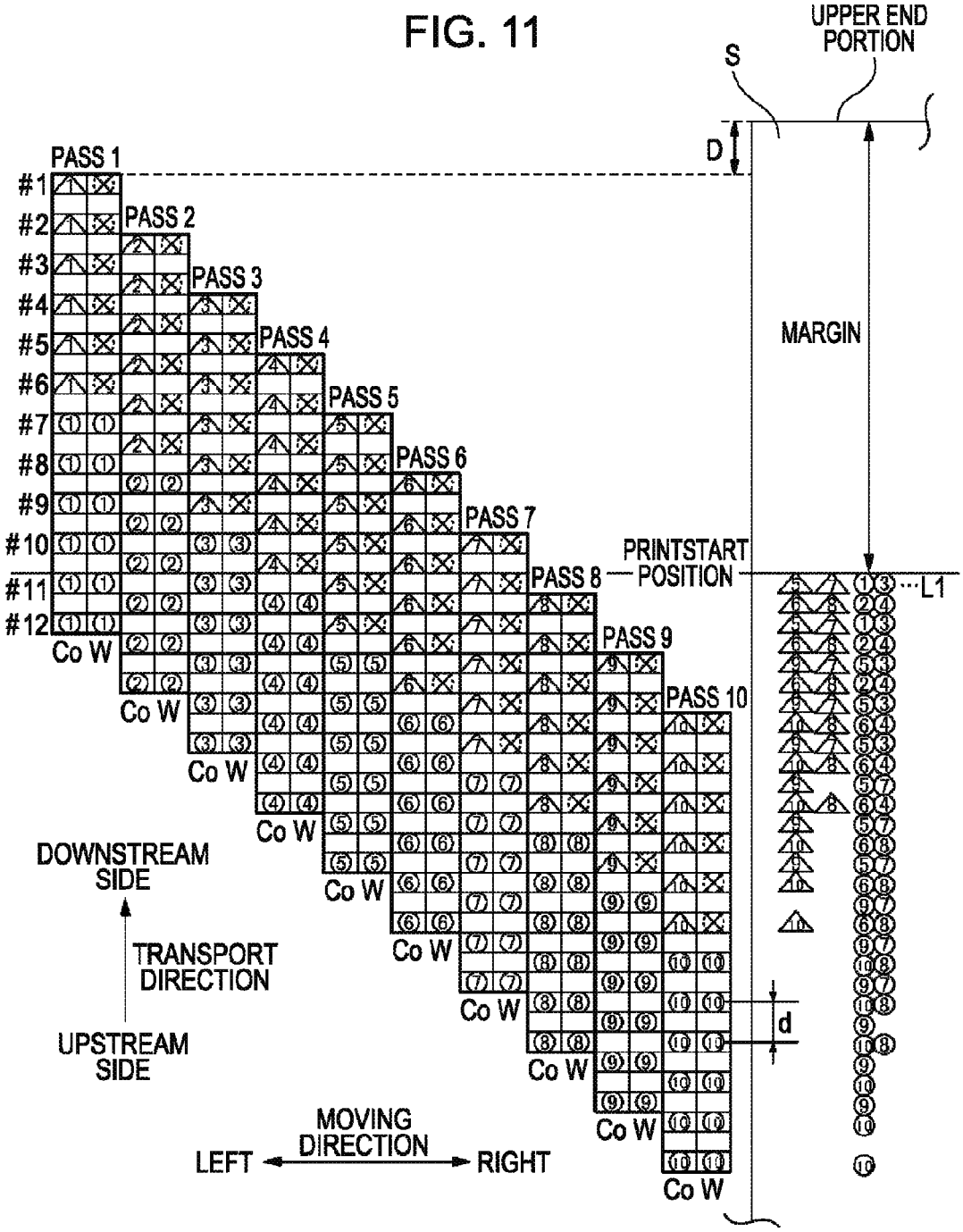
FIG. 11 is a diagram showing an aspect in which the upper end portion of the medium is printed by overlap printing in the 5-color print mode of the comparative example.
Figure 12:
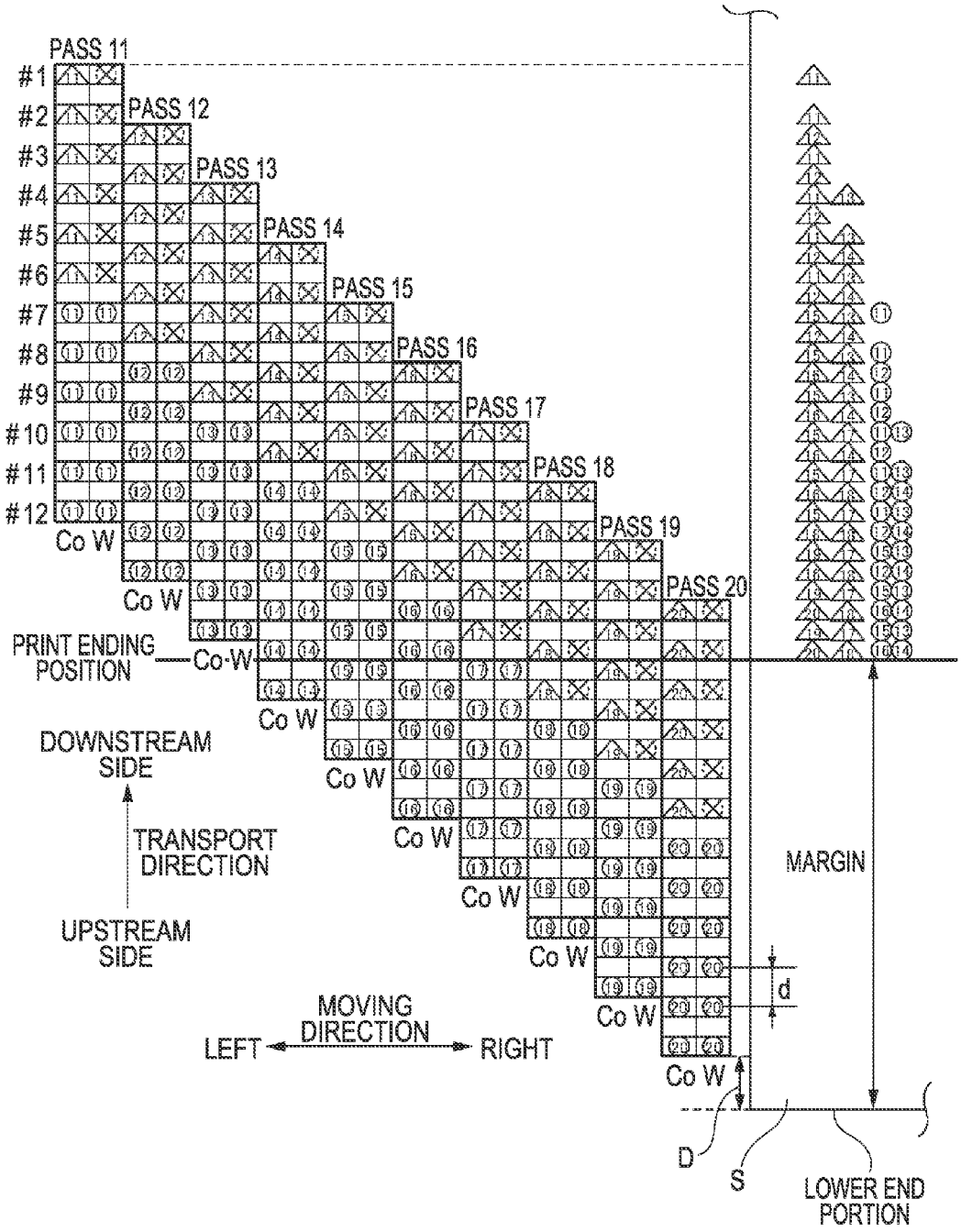
FIG. 12 is a diagram showing an aspect in which the lower end portion of the medium is printed by the overlap printing in the 5-color print mode of the comparative example.

FIG. 11 is a diagram showing an aspect in which the upper end portion of the medium S is printed by the overlap printing in the 5-color printing mode of the comparative example, and FIG. 12 is a diagram showing an aspect in which the lower end portion of the medium S is printed by the overlap printing in the 5-color printing mode of the comparative example. For simplification of explanation, the nozzles are depicted with the number thereof reduced to 12 (#1 to #12). The nozzles of the color nozzle row Co for printing a color image and dots constituting the color image are represented by triangles, and the nozzles of the white nozzle row W and the color nozzle row Co for printing a background image of toned white and dots constituting the background image are represented by circles. Also, a numeral stated in the circle or the triangle representing the nozzle or the dot is the pass number.

In the overlap printing in the 5-color print mode of the comparative example, the nozzles for printing a background image of toned white are set to be the nozzles (#7 to #12) of a half on the upstream side in the transport direction of each of the white nozzle row W and the color nozzle row Co, and the nozzles for printing a color image are set to be the nozzles (#1 to #6) of a half on the downstream side in the transport direction of the color nozzle row Co.

Next, a concrete printing method (the printing method of the upper end portion of the medium S) will be explained. In the comparative example, a transport amount of the medium S is set to be a "1.5 d (=3 frames)" which is 1.5 times the nozzle pitch d (=2 frames). As shown in FIG. 11, at the time of the start of the printing (the paper feed position thereof), the upper end portion of the medium S is in a state where it is located on the downstream side in the transport direction a length D farther than the end portion on the downstream side in the transport direction of the head 41 (of Pass 1). Then, since a thick line of FIG. 11 is the print start position, in Pass 1, a background image of toned white is printed by two nozzles #11 and #12 on the upstream side in the transport direction of each of the white nozzle row W and the color nozzle row Co. Thereafter, the medium S is transported by 1.5 d (3 frames).

In Pass 2, a background image is printed by three nozzles #10 to #12 of each of the white nozzle row W and the color nozzle row Co, in Pass 3, a background image is printed by five nozzles #8 to #12 of each of the white nozzle row W and the color nozzle row Co, and in Pass 4, a background image is printed by six nozzles #7 to #12 of each of the white nozzle row W and the color nozzle row Co. Thereafter, in Pass 5, a color image is printed by two nozzles #5 and #6 of the color nozzle row Co and an image is printed by six nozzles #7 to #12 of each of the white nozzle row W and the color nozzle row Co, in Pass 6, a color image is printed by three nozzles #4 to #6 of the color nozzle row Co and an image is printed by six nozzles #7 to #12 of each of the white nozzle row W and the color nozzle row Co, and in Pass 7, a color image is printed by five nozzles #2 to #6 of the color nozzle row Co and an image is printed by six nozzles #7 to #12 of the white nozzle row W and the color nozzle row Co.

In the subsequent pass, an operation for printing a color image by the nozzles (#1 to #6) of a half on the upstream side in the transport direction of the color nozzle row Co and printing a background image by the nozzles (#7 to #12) of a half on the downstream side in the transport direction of each of the white nozzle row W and the color nozzle row Co and an operation for transporting the medium S by 1.5 d are alternately repeated.

As a result, it is possible to print a color image on a background image in a different posterior pass. Also, as shown in the right drawing of FIG. 11, one raster line constituting a background image is formed by dots (circles) by two kinds of nozzles of each of the white nozzle row W and the color nozzle row Co, and one raster line constituting a color image is formed by dots (triangles) by two kinds of nozzles of the color nozzle row Co. For example, at a raster line L1 on the most downstream side (the upper end side) in the transport direction, a background image is printed by the nozzles of the white nozzle row W and the color nozzle row Co in Passes 1 and 3 and a color image is printed by the nozzles of the color nozzle row Co in subsequent Passes 5 and 7.

As shown in FIG. 11, in the overlap printing in the 5-color print mode of the comparative example, the position of the raster line which is formed by the nozzle #11 on the upstream side in the transport direction in a state where the upper end portion of the medium S is protruded by a length D from the head 41 at the time of the start of the printing becomes the print start position. That is, the print start position is on the upstream side in the transport direction with respect to the head 41, so that the position control range of the medium S becomes longer and a margin amount of the medium S becomes larger. Also, in the comparative example, since ink droplets are not ejected from the nozzles (#1 to #6) on the downstream side in the transport direction of the white nozzle row W, there is a fear that thickening of ink occurs, thereby generating an ejection defect.

Next, as shown in FIG. 12, a printing method of the lower end portion of the medium S will be explained. Here, Pass 20 is set to be a final pass. Up to Pass 13, an operation for printing a color image by the nozzles (#1 to #6) of a half on the downstream side of the color nozzle row Co and printing a background image by the nozzles (#7 to #12) of a half on the upstream side of each of the white nozzle row W and the color nozzle row Co and an operation for transporting the medium S by 1.5 d are alternately repeated. Then, in Pass 14 and after it, the number of nozzles which eject ink droplets is gradually reduced.

In Pass 14, a color image is printed by six nozzles #1 to #6 of the color nozzle row Co and a background image is printed by five nozzles #7 to #11 of each of the white nozzle row W and the color nozzle row Co, in Pass 15, a color image is printed by six nozzles #1 to #6 of the color nozzle row Co and a background image is printed by three nozzles #7 to #9 of each of the white nozzle row W and the color nozzle row Co, and in Pass 16, a color image is printed by six nozzles #1 to #6 of the color nozzle row Co and an image is printed by two nozzles #7 and #8 of each of the white nozzle row W and the color nozzle row Co. Thereafter, in Pass 17, a color image is printed by six nozzles #1 to #6 of the color nozzle row Co, in Pass 18, a color image is printed by five nozzles #1 to #5 of the color nozzle row Co, in Pass 19, a color image is printed by three nozzles #1 to #3 of the color nozzle row Co, in Pass 20, a color image is printed by two nozzles #1 and #2 of the color nozzle row Co, and then the printing is finished.

As shown in FIG. 12, at the time of the lower end printing of the comparative example, the position of the raster line which is formed by the nozzle #2 of the color nozzle row Co in a state where the lower end portion of the medium S is protruded by a length D from the head 41 at the time of the ending of the printing becomes the print ending position. That is, the print ending position is on the downstream side in the transport direction with respect to the head 41, so that the position control range of the medium S becomes longer and a margin amount of the medium S becomes larger.

Also in the overlap printing in the 5-color print mode of the comparative example, a target is to make the position control range of the medium S as short as possible.

5-Color Print Mode of this Embodiment

Figure 13:
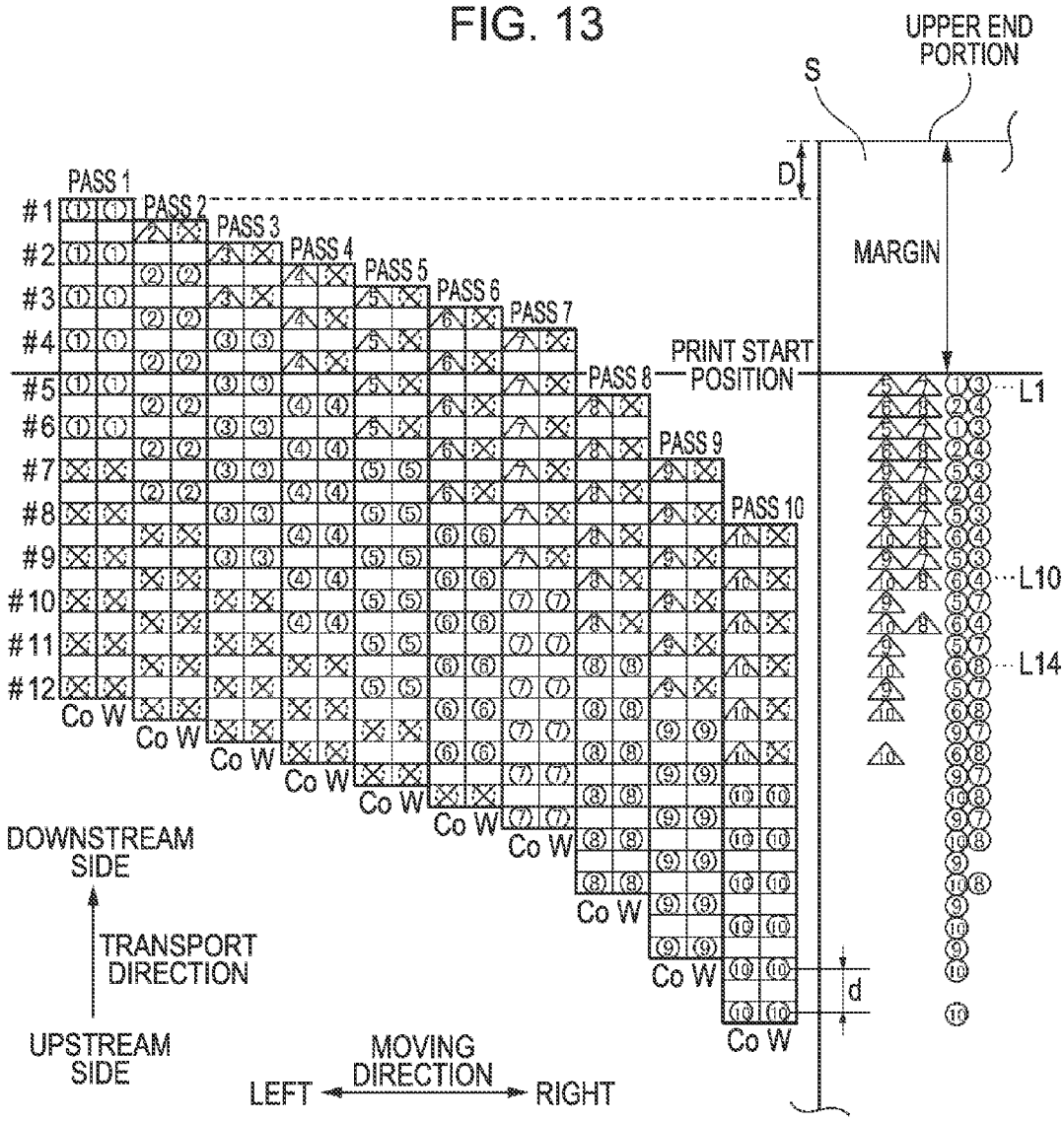
FIG. 13 is a diagram showing an aspect in which the upper end portion of the medium is printed in the overlap printing in the 5-color print mode of the embodiment.
Figure 14:
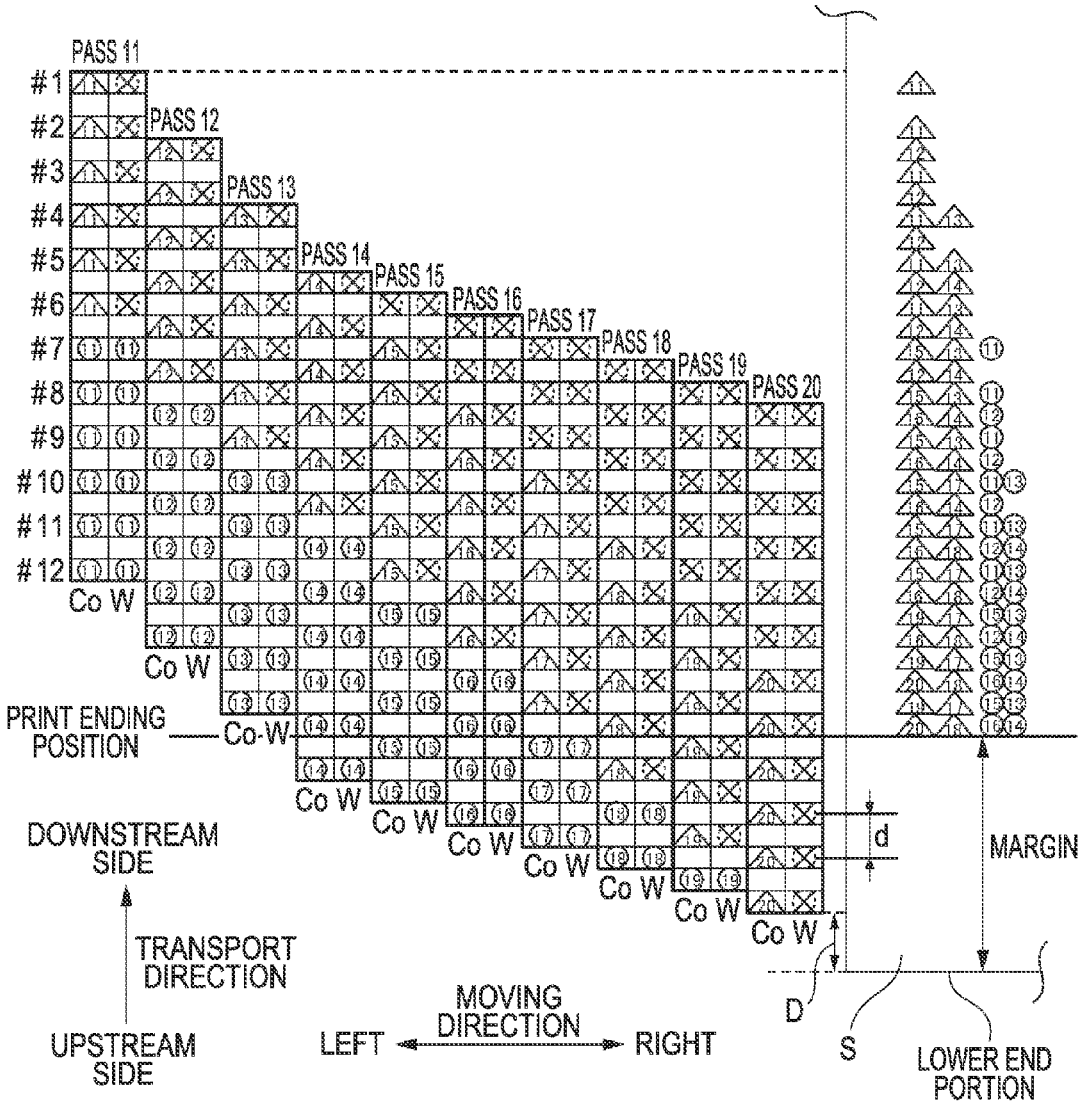
FIG. 14 is a diagram showing an aspect in which the lower end portion of the medium is printed in the overlap printing in the 5-color print mode of the embodiment.

FIG. 13 is a diagram showing an aspect in which the upper end portion of the medium S is printed in the overlap printing in the 5-color printing mode of the embodiment, and FIG. 14 is a diagram showing an aspect in which the lower end portion of the medium S is printed in the overlap printing in the 5-color printing mode of the embodiment. In this embodiment, similarly to the above-described band printing, in order to make the position control range of the medium S as short as possible, a background is printed by using also the nozzles on the downstream side in the transport direction without fixing the nozzle of the white nozzle row W and the color nozzle row Co for printing the background image of toned white to the nozzles of a half on the upstream side in the transport direction. Also, a color image is printed by using also the nozzles on the upstream side in the transport direction without fixing the nozzle of the color nozzle row Co for printing the color image to the nozzles on the downstream side in the transport direction.

First, the printing of the upper end portion of the medium S is specifically explained by using FIG. 13. The paper feed position at the time of the start of the printing is a position in which the upper end portion of the medium S is shifted to the downstream side in the transport direction a length D farther than the end portion on the downstream side in the transport direction of head 41 of Pass 1. In Pass 1, six nozzles (#1 to #6) from the most downstream side in the transport direction of each of the white nozzle row W and the color nozzle row Co are set to be the ejection-able nozzles for a background image. However, as shown in FIG. 13, since the position of the raster line which is formed by the nozzle #5 of the head 41 of Pass 1 becomes the print start position (a thick line), in Pass 1, a background image is printed by two nozzles #5 and #6 of each of the white nozzles row W and the color nozzle row Co. Thereafter, the medium S is transported by a length 0.5 d (=1 frame) of a half of the nozzle pitch d.

In subsequent Pass 2, the nozzles #2 to #7 of the white nozzle row W and the color nozzle row Co are set to be the ejection-able nozzles for a background image and the nozzle #1 of the color nozzle row Co is set to be the ejection-able nozzle for a color image. However, ink droplets are ejected from three nozzles #5 to #7 of each of the white nozzle row W and the color nozzle row Co. Thereafter, the medium S is transported by half a nozzle pitch 0.5 d. In this manner, in the overlap printing of this embodiment, the ejection-able nozzles (circles) for a background image and the ejection-able nozzles (triangles) for a color image are shifted one by one to the upstream side in the transport direction for every pass. However, ink droplets are ejected from the nozzles which are located further on the upstream side in the transport direction than the print start position (a thick line) in the drawing, among the ejection-able nozzles.

In Pass 3, the nozzles #3 to #8 of the white nozzle row W and the color nozzle row Co are set to be the ejection-able nozzles for a background image and the nozzles #1 and #2 of the color nozzle row Co are set to be the ejection-able nozzles for a color image. However, ink droplets are ejected from the nozzles #4 to #8. In Pass 4, the nozzles #4 to #9 of the white nozzle row W and the color nozzle row Co are set to be the ejection-able nozzles for a background image and the nozzles #1 to #3 of the color nozzle row Co are set to be the ejection-able nozzles for a color image. However, ink droplets are ejected from the nozzles #4 to #9. In Pass 5, the nozzles #5 to #10 of the white nozzle row W and the color nozzle row Co are set to be the ejection-able nozzles for a background image and the nozzles #1 to #4 of the color nozzle row Co are set to be the ejection-able nozzles for a color image. However, ink droplets are ejected from the nozzles #3 to #10. In Pass 6, the nozzles #6 to #11 of the white nozzle row W and the color nozzle row Co are set to be the ejection-able nozzles for a background image and the nozzles #1 to #5 of the color nozzle row Co are set to be the ejection-able nozzles for a color image. However, ink droplets are ejected from the nozzles #3 to #11. In Pass 7, the nozzles #7 to #12 of the white nozzle row W and the color nozzle row Co are set to be the ejection-able nozzles for a background image and the nozzles #1 to #6 of the color nozzle row Co are set to be the ejection-able nozzles for a color image. However, ink droplets are ejected from the nozzles #2 to #12. Then, from Pass 1 to the front of Pass 7, a transport amount of the medium S is set to be half a nozzle pitch 0.5 d.

As a result, it is possible to print a color image on a background image in a different posterior pass. Then, as shown in the right drawing of FIG. 13, one raster line constituting a background image is formed by dots by two kinds of nozzles of each of the white nozzle row W and the color nozzle row Co, and one raster line constituting a color image is formed by dots by two kinds of nozzles of the color nozzle row Co.

Thereafter (Pass 8 and after it), an operation for printing a color image by the nozzles (#1 to #6) of a half on the downstream side in the transport direction of the color nozzle row Co and printing a background image by the nozzles (#7 to #12) of a half on the upstream side in the transport direction of each of the white nozzle row W and the color nozzle row Co and an operation for transporting the medium S by 1.5 d (=3 frames) which is a length of 1.5 times the nozzle pitch are alternately repeated.

As described above, here, a pass in which the number of nozzles used (the number of nozzles which eject ink) or the positions of the nozzles are different from those in the normal printing is set to be the upper end printing, and in a case where a transport amount of the medium after a certain pass is different from that in the normal printing, the pass is set to be the upper end printing. Therefore, in FIG. 13, an operation from Pass 1 to Pass 7 (the transport operation after it) corresponds to the upper end printing (the time of the image formation of the upper end portion of the medium), and an operation in Pass 8 and after it corresponds to the normal printing (the time of the normal image formation).

In this manner, also in the overlap printing, at the time of the upper end printing, a background image is printed by using the nozzles different from the nozzles (#7 to #12) which print a background image at the time of the normal printing. Additionally speaking, the nozzles which print a background image at the time of the upper end printing are set to be nozzles which are located further on the downstream side in the transport direction than the nozzles which print a background image at the time of the normal printing.

As a result, in the comparative example (FIG. 11), the position of the raster line which is formed by the nozzle #11 of the head 41 of Pass 1 becomes the print start position, whereas in this embodiment, as shown in FIG. 13, the position of the raster line which is formed by the nozzle #5 of the head 41 of Pass 1 becomes the print start position (a thick line). Therefore, in this embodiment, it is possible to make the print start position be further on the downstream side in the transport direction than that in the comparative example, so that the position control range of the medium S can be shortened, whereby a margin amount of the medium S can become smaller.

In addition, at the time of the upper end printing, the ejection-able nozzles (circles) for a background image are shifted to the upstream side in the transport direction in accordance with the progress of the printing. Also, at the time of the upper end printing, in accordance with the transition of the ejection-able nozzles for a background image to the upstream side in the transport direction, the ejection-able nozzles (triangles) for a color image are also increased to the upstream side in the transport direction. By doing so, a transition from the upper end printing to the normal printing is possible, so that on the background image printed in the prior pass, a color image can be printed in the posterior pass.

Also, in the comparative example, since the nozzles (#1 to #6) of a half on the downstream side in the transport direction of the white nozzle row W are not used for the printing, there is a fear that thickening of ink in the nozzles on the downstream side occurs, thereby generating an ejection defect. On the contrary, in this embodiment, since the nozzles on the downstream side in the transport direction of the white nozzle row W are also used for the printing, an ejection defect can be prevented. Also, in this embodiment, since not only the nozzles on the upstream side of the white nozzle row W, but also the nozzles on the downstream side are used, so that many kinds of nozzles are used, a difference in characteristic between nozzles can be alleviated.

Also, in order to make the dot formation methods at the time of the normal printing and the time of the upper end printing be the same, the total amount of a shift amount of the ejection-able nozzle to the upstream side in the transport direction for every pass at the time of the upper end printing and a transport amount of the medium S at the time of the upper end printing is made to be the same as a transport amount of the medium S at the time of the normal printing. At the time of the normal printing, a positional relationship between the ejection-able nozzles (#7 to #12) for a background image and the medium S is shifted to the transport direction by 1.5 nozzles (3 frames) for every pass. On the other hand, at the time of the upper end printing, the ejection-able nozzles for a background image are shifted one by one to the upstream side in the transport direction in accordance with the progress of the printing. That is, at the time of the upper end printing, a transport amount of the medium S is half a nozzle (1 frame), and the position of the ejection-able nozzle is shifted by one nozzle (2 frames) to the upstream side in the transport direction for every pass. As a result, also at the time of the upper end printing, similarly to the time of the normal printing, a positional relationship between the ejection-able nozzles and the medium S is shifted by 1.5 nozzles (3 frames) for every pass.

This can also be found from the fact that a relative position of the nozzle on the most upstream side among the ejection-able nozzles (circles) for a background image to the medium S is shifted by 3 frames (1.5 nozzles) for every pass not only at the time of the upper end printing (Pass 1 to Pass 7), but also at the time of the normal printing (Pass 8 and after it), as shown in FIG. 13. For example, in FIG. 13, the nozzle #6 on the most upstream side among the ejection-able nozzles for a background image in Pass 1 at the time of the upper end printing and the nozzle #7 on the most upstream side among the ejection-able nozzles for a background image in Pass 2 are shifted by three frames (1.5 nozzles). Similarly, the nozzle #12 on the most upstream side among the ejection-able nozzles for a background image in Pass 8 at the time of the normal printing and the nozzle #12 on the most upstream side among the ejection-able nozzles for a background image in Pass 9 are also shifted by three frames (1.5 nozzles).

As a result, it is possible to make the time after the printing of a background image and until the printing of a color image thereon be the same as those at the time of the upper end printing and the time of the normal printing. For example, as shown in the right drawing of FIG. 13, since at a raster line L1 on the most downstream side in the transport direction, after the printing of a background image by Pass 3, a color image is printed by Pass 5, a color image is printed with one pass skipped after the printing of a background image. Similarly, at the tenth raster line L10, after the printing of a background image by Pass 6, a color image is printed by Pass 8, and at the fourteenth raster line L14, after the printing of a background image by Pass 8, a color image is printed by Pass 10, whereby a color image is printed with one pass skipped after the printing of a background image. In this manner, by making the interval between the printing of a background image and the printing of a color image be constant at the time of the upper end printing and the time of the normal printing, density unevenness of an image can be prevented.

Also, not only at the time of the upper end printing, but also at the time of the normal printing, at one raster line, an interval where background images are formed by two kinds of nozzles (two kinds of white nozzles or two kinds of color nozzles) and an interval where color images are formed by two kinds of nozzles can become constant. For example, at the raster line L1, background images are formed in Pass 1 and Pass 3 (an interval is one pass) and color images are formed in Pass 5 and Pass 7 (an interval is one pass). Similarly, at the raster line L10, background images are formed in Pass 4 and Pass 6 (an interval is one pass) and color images are formed in Pass 8 and Pass 10 (an interval is one pass). In this manner, by making the printing methods (dot formation methods) of the upper end printing and the normal printing be the same, density unevenness of an image can be prevented. In addition, at one raster line, an interval in which background images are formed by two kinds of nozzles, an interval between the printing of a background image and the printing of a color image, and an interval in which color images are formed by two kinds of nozzles are all constant (all of the intervals are one pass).

Further, in this embodiment, by making a shift amount of the ejection-able nozzle (a circle) for a background image to the upstream side in the transport direction at the time of the upper end printing constant, the nozzles on the downstream side in the transport direction of the white nozzle row W can be averagely used. Also, by making a shift amount of the ejection-able nozzle for a background image to the upstream side in the transport direction at the time of the upper end printing constant, a transport amount of the medium S becomes constant. As a result, the transport operation can be stabilized, so that printing control can be easily performed.

Next, the printing of the lower end portion of the medium S will be explained by using FIG. 14. Here, the printing is set to be finished at Pass 20. An operation up to Pass 13 (the transport operation after it) is set to be the normal printing (the time of the normal image formation), and an operation for printing a color image by the nozzles (#1 to #6) of a half on the downstream side in the transport direction of the color nozzle row Co and printing a background image by the nozzles (#7 to #12) of a half on the upstream side in the transport direction of each of the white nozzle row W and the color nozzle row Co and an operation for transporting the medium S by 1.5 d are alternately repeated. Then, an operation from Pass 14 to Pass 20 corresponds to the time of the image formation of the lower end portion of the medium.

In Pass 14, the nozzles (#1 to #6) of a half on the downstream side in the transport direction of the color nozzle row Co are set to be the ejection-able nozzles for a color image and the nozzles (#7 to #12) of a half on the upstream side in the transport direction of each of the white nozzle row W and the color nozzle row Co are set to be the ejection-able nozzles for a background image. However, as shown in FIG. 14, the position of the raster line which is formed by the nozzle #11 of the head 41 of Pass 14 becomes the print ending position (a thick line). Therefore, in Pass 14, from the nozzle #12, ink droplets are not ejected. Then, in Pass 14 and after it, the medium S is transported by an amount reduced to a length 0.5 d (1 frame) of a half of the nozzle pitch d.

In subsequent Pass 15, the nozzles #2 to #7 of the color nozzle row Co are set to be the ejection-able nozzles for a color image and the nozzles #8 to #12 of the white nozzle row W and the color nozzle row Co are set to be the ejection-able nozzles for a background image. However, from the nozzles #11 and #12 of the white nozzle row W, ink droplets are not ejected. In this manner, in the lower end printing, at the white nozzle row W and the color nozzle row Co, the ejection-able nozzles are shifted one by one to the upstream side in the transport direction for every pass. However, among the ejection-able nozzles, from the nozzles which are located further on the upstream side in the transport direction than the print ending position (a thick line) in the drawing, ink droplets are not ejected.

In Pass 16, the nozzles #3 to #8 of the color nozzle row Co are set to be the ejection-able nozzles for a color image and the nozzles #9 to #12 of the white nozzle row W and the color nozzle row Co are set to be the ejection-able nozzles for a background image. However, from the nozzles #11 and #12, ink droplets are not ejected. In Pass 17, a color image is printed by ejecting ink droplets from the nozzles #4 to #9 of the color nozzle row Co, in Pass 18, a color image is printed by ejecting ink droplets from the nozzles #5 to #9 of the color nozzle row Co, in Pass 19, a color image is printed by ejecting ink droplets from the nozzles #6 to #8 of the color nozzle row Co, and in Pass 20, a color image is printed by ejecting ink droplets from the nozzles #7 and #8 of the color nozzle row Co.

In this manner, at the time of the lower end printing, a color image is printed by using the nozzles different from the nozzles (#1 to #6) which print a color image at the time of the normal printing. Additionally speaking, the nozzles which print a color image at the time of the lower end printing are set to be nozzles which are located further on the upstream side in the transport direction than the nozzles which print a color image at the time of the normal printing.

As a result, in the comparative example (FIG. 12), the position of the raster line which is formed by the nozzle #2 of the head 41 of Pass 20 becomes the print ending position, whereas in this embodiment, as shown in FIG. 14, the position of the raster line which is formed by the nozzle #8 of the head 41 of Pass 20 becomes the print ending position (a thick line). That is, in this embodiment, it is possible to make the print ending position be further on the upstream side in the transport direction than that in the comparative example, so that the position control range of the medium S can be shortened, whereby a margin amount of the medium S can become smaller.

In addition, at the time of the lower end printing, the ejection-able nozzles (triangles) of the color nozzle row Co for printing a color image are shifted to the upstream side in the transport direction in accordance with the progress of the printing. Also, at the time of the lower end printing, in accordance with the transition of the ejection-able nozzles of the color nozzle row Co for printing a color image to the upstream side in the transport direction, the ejection-able nozzles (circles) of the white nozzle row W and the color nozzle row Co for printing a background image are reduced to the upstream side in the transport direction. By doing so, the transition from the normal printing to the lower end printing is possible, so that on the background image printed in the prior pass, a color image can be printed in the posterior pass.

Also, in order to make the dot formation methods at the time of the lower end printing and the time of the normal printing be the same, the total amount of a shift amount of the ejection-able nozzle for a color image to the upstream side in the transport direction at the time of the lower end printing and a transport amount of the medium S at the time of the lower end printing is made to be the same as a transport amount of the medium S at the time of the normal printing. At the time of the normal printing, a positional relationship between the ejection-able nozzles (#1 to #6) for a color image of the color nozzle row Co and the medium S is shifted by 1.5 nozzles (3 frames) to the transport direction for every pass. Therefore, at the time of the lower end printing, a transport amount of the medium S is set to be half a nozzle (1 frame), and the position of the ejection-able nozzle for a color image is shifted one nozzle (2 frames) to the upstream side in the transport direction for every pass. By doing so, it is possible to make the interval between the printing of a background image and the printing of a color image constant at the time of the normal printing and the time of the lower end printing, so that density unevenness of an image can be suppressed. Further, in this embodiment, by making a shift amount of the ejection-able nozzle for a color image to the upstream side in the transport direction at the time of the lower end printing constant, a transport amount of the medium S becomes constant. As a result, the transport operation can be stabilized, so that printing control can be easily performed.

Concerning Background Image of Toned White

Heretofore, the nozzles which are used when printing a color image which is formed by color ink, on a background image of toned white formed by white ink and color ink (YMCK) has been explained. Next, a toned white designation processing for printing desired white color by mixing color ink to white ink and a generation processing of print data for printing a background image of toned white will be explained. The following processing is executed by a printer driver installed in the computer 60 externally connected to the printer 1.

Concerning Toned White Designation Processing

Figure 15:
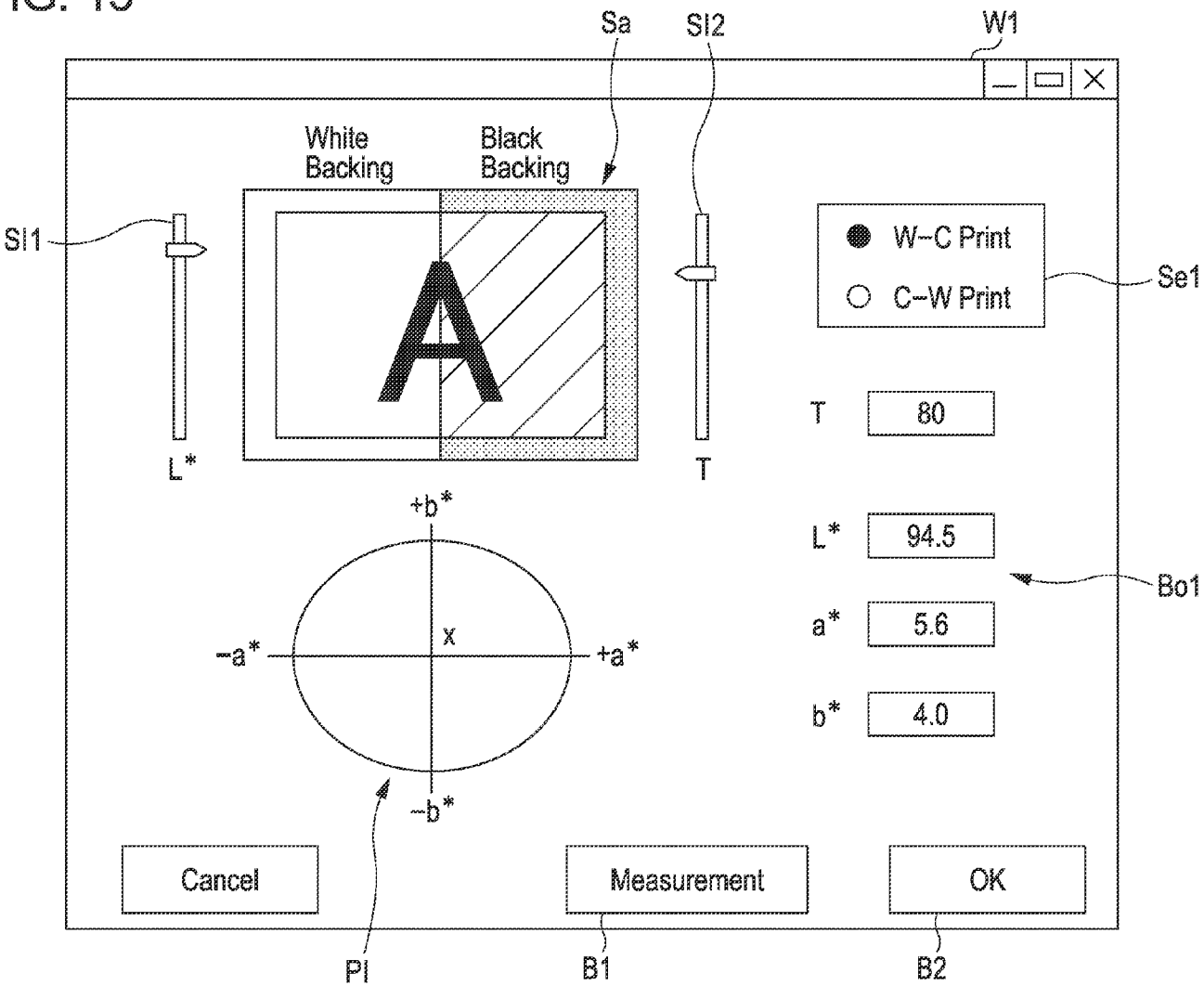
FIG. 15 is an explanatory diagram showing one example of a window for toned white designation.

FIG. 15 is an explanatory diagram showing one example of a window for toned white designation. The printer driver displays a window for toned white designation, W1, shown in FIG. 15 to a user upon the receipt of image data which includes a (background) image of toned white from various application programs. The window for toned white designation, W1, includes a sample image display area Sa, two slider bars S11 and S12, an a-b plane display area P1, a print order designation field Se1, a value input box Bo1, a measurement button (Measurement) B1, and an OK button B2.

In the window for toned white designation, W1, shown in FIG. 15, the sample image display area Sa is a region for displaying a sample image of designated toned white. The sample image display area Sa is two-divided into the left and the right, the left side is a region (a white background area) which displays toned white in a white background (White Backing), and the right side is a region (a black background area) which displays toned white in a black background (Black Backing). In addition, an outermost peripheral region of the sample image display area Sa is a region (a background color region) which displays a background color (white or black), and an inside region of the background color region is a "white image region" which displays toned white (that is, it displays a color when a background image of toned white has been printed). Also, a color image (an image of "A" in the drawing) is displayed in the vicinity of the center of the sample image display area Sa.

The value input box Bo1 in the window W1 is a portion for designating "toned white" by inputting colorimetric values (an L* value (hereinafter also simply represented as an "L value"), an a* value (hereinafter also simply represented as an "a value"), and a b* value (hereinafter also simply represented as a "b value")) in a L*a*b* colorimetric system and a T value. The L value is a value which represents brightness of toned white, and is mutually related to the amount of black (K) ink when printing an image of toned white. The a value and the b value are values which represent chromaticity along a red-green axis and a yellow-blue axis of toned white, and are mutually related to the amount of color ink when printing an image of toned white. The T value is a value which represents density, and is mutually related to the amount of ink per a unit area when printing an image of toned white. That is, the T value is mutually related to transmittance of a background color. In addition, toned white corresponding to the Lab value and the T value can also be designated by the slider bars S11 and S12 and the a-b plane display area P1.

The print order designation field Se1 of the window W1 is a portion which represents designation of a print order set by various application programs. Heretofore, a printed matter (so-called surface printing; "W-C Print" in the drawing) in which a background image of toned white is printed by white ink and color ink (YMCK) and a color image is printed on the background image by color ink is taken as an example. However, the invention is not limited thereto. For example, a printed matter (so-called backing printing; "C-W Print" in the drawing) may also be adopted in which a color image is printed on a medium such as a transparency film and a background image is printed on the color image, whereby an image is seen from the opposite side to the printed surface of the medium. That is, in the print order designation field Se1, whether an image of toned white is first printed or a color image is first printed is shown.

If a user inputs a value to the value input box Bo1, a color of the sample image display area Sa is changed to a color (toned white) which is specified by the input value. For example, if a user changes the a value or the b value, a hue of a color (toned white) of the white image region of the sample image display area Sa is changed, and if the L value is changed, brightness of a color of the white image region is changed. In addition, in a case where the T value is changed, since transmittance of a background color is changed, brightness of a color of the white image region in the black background area of the sample image display area Sa is changed, but a color of the white image region in the white background area is not changed. Therefore, a change in a color according to a change in the T value (a density value) can be easily confirmed by contrasting the black background area with the white background area in the sample image display area Sa, so that a user can more accurately and more easily designate toned white. Then, when the white image region of the sample image display area Sa coincides with a white color desired by a user, the OK button is operated by the user.

In this way, the printer driver can obtain a value (the Lab value and the T value) related to a color of a toned white image which the user desires. In addition, a configuration may also be made such that an image of toned white is actually printed on the basis of a value (the Lab value or the T value) designated by a user and color measurement (Measurement) of the printed image is performed. On the basis of the color measurement result, the user can more accurately and more easily designate a value (the Lab value and the T value) related to a color of a toned white image.

Concerning Print Data Generation Processing

Next, the printer driver executes a color conversion processing of a toned white image, an ink color separation processing, and a halftone processing. First, the printer driver performs color conversion of a "Lab value" set by the toned white designation processing into an "YMCK value". The color conversion is carried out with reference to a look-up table for a toned white image, LUTw1, (not shown). In the look-up table for a toned white image LUTw1, a correspondence relationship between a preset Lab value and the "YMCK value is prescribed. In addition, in the look-up table for a toned white image, LUTw1, each gradation value of YMCK is prescribed as a value (a relatively light value) in the range of 0 or more and 100 or less.

Next, the printer driver performs the ink color separation processing which converts the combination of the "YMCK value" color-converted from the Lab value of a toned white image and the "T value" set by the toned white designation processing, into a gradation value for each ink color. In the printer 1 of this embodiment, ink of a total of five colors, cyan C, magenta M, yellow Y, black K, and white W, can be used for the printing. Accordingly, in the ink color separation processing, the combination of the YMCK value and the T value is converted into a gradation value of each of five ink colors (YMCKW).

The ink color separation processing is also executed with reference to another look-up table for a toned white image, LUTw2, (not shown). In the look-up table for a toned white image LUTw2, a correspondence relationship between the combination of a preset YMCK value and the T value and the gradation value of each of the ink colors (YMCKW) is prescribed. In addition, in the look-up table for a toned white image, LUTw2, the gradation value of the ink color is prescribed as a value in the range of 0 or more and 256 or less (as 256 gradation values).

Next, the printer driver executes the halftone processing which converts high gradation data (256 gradation data) into ON/OFF data (hereinafter referred to as dot data) of a dot which a printer can express. For example, the printer driver takes out a gradation value (high gradation data) for each ink color of one pixel and converts it into low gradation data (dot data) with reference to a dither pattern for every ink color.

In the same way, the printer driver executes the ink color separation processing and the halftone processing also with respect to a color image (YMCK image). The printer driver converts color image data into a gradation value of each of ink colors (YMCK) usable in the printer 1, with reference to a look-up table for a color image (not shown). If the color image data which the printer driver has received from an application program is, for example, RGB data, the printer driver converts it into YMCK data by the ink color separation processing. Then, the printer driver executes the halftone processing with respect to the YMCK data for a color image and converts the high gradation data into the dot data.

By the above-described processing, the printer driver obtains dot data (YMCKW) for printing a (background) image of toned white and dot data (YMCK) for printing a color image. The printer driver sends the dot data obtained in this way, along with other command data (ink classification, print order, or the like), to the printer 1.

Concerning Processing of Printer 1

Figure 16:
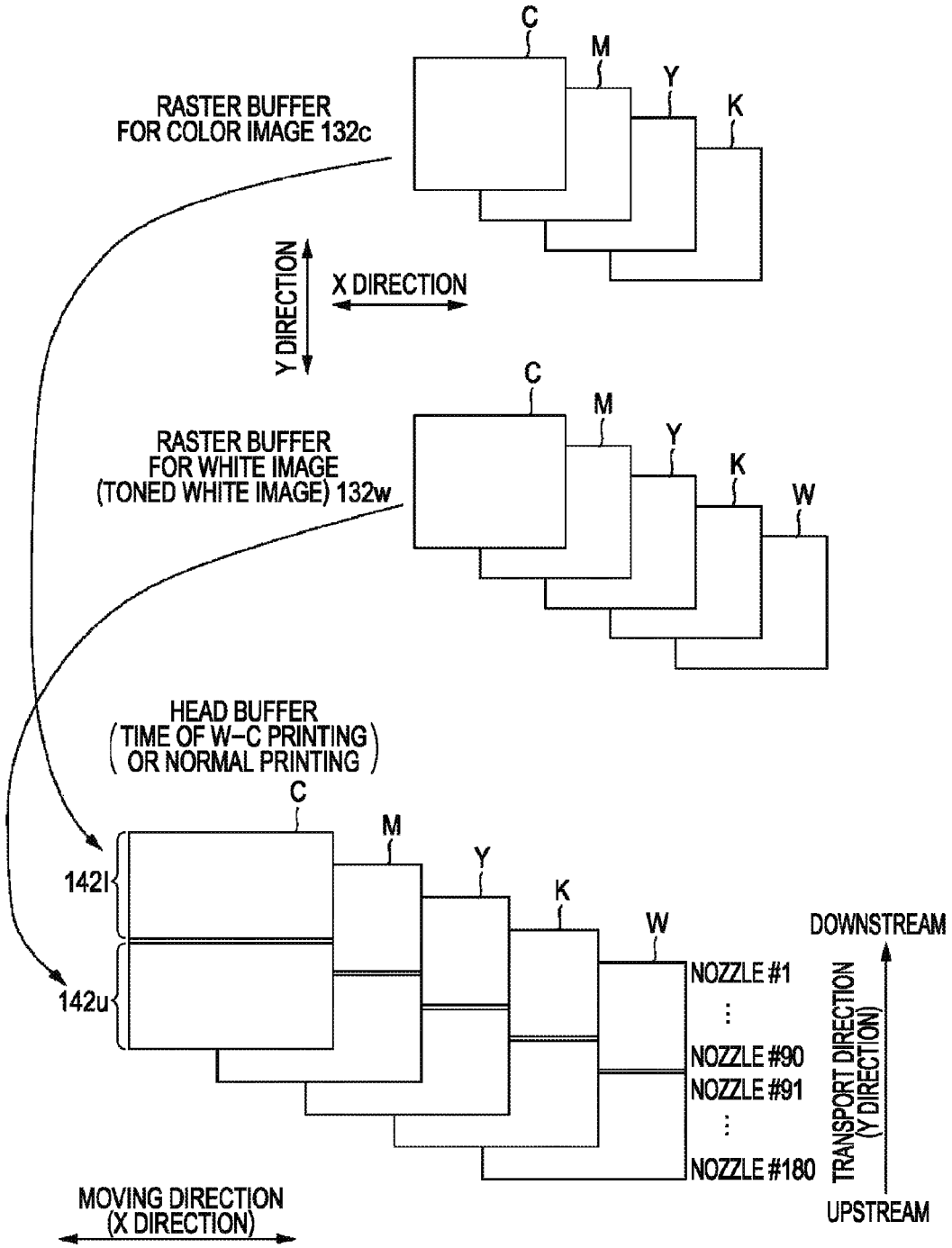
FIG. 16 is an explanatory diagram showing the detailed configurations of a raster buffer and a head buffer.

FIG. 16 is an explanatory diagram showing the detailed configurations of a raster buffer and a head buffer. The printer 1 of this embodiment has a raster buffer. The controller 10 stores a portion (for example, data for one pass) of the dot data which the printer 1 has received from the printer driver, in the raster buffer. Also, the raster buffer includes two regions, a raster buffer for a color image, 132*c*, and a raster buffer for a white image (a toned white image), 132*w*. In addition, at the upper stage of FIG. 16, the raster buffer for a color image, 132*c*, is shown, and at the middle stage, the raster buffer for a white image (a toned white image), 132*w*, is shown. Also, the head unit 40 has the head buffer. The head buffer includes a head buffer for upstream, 142*u*, and a head buffer for downstream, 142*l*.

The controller 10 stores dot data related to a color image in the raster buffer for a color image, 132*c*, and stores dot data related to a white image (a toned white image or a background image) in the raster buffer for a white image, 132*w*. Also, as shown in FIG. 16, in the raster buffer, a region can be assigned for each ink (YMCKW). Therefore, the controller 10 stores a portion of the received dot data in a corresponding raster buffer for each ink. In addition, here, a size in a X direction (corresponding to the moving direction of the head 41) of each region of the raster buffer is a size of an image width (the moving distance of the head 41), and a size in a Y direction (corresponding to the transport direction) of each region is a size of ½ or more of the length of the nozzle row.

At the lower stage of FIG. 16, the head buffer is shown. As shown in FIG. 16, in the head buffer, a region can be assigned for every nozzle row (YMCKW) of the head 41. That is, the head buffer is constituted as assembly of a region for cyan, a region for magenta, a region for yellow, a region for black, and a region for white. A size in the X direction (the moving direction) of each region of the head buffer is a size of the moving distance of the head 41, and a size in the Y direction (the transport direction) of each region of the head buffer is a size corresponding to the number of nozzles constituting the nozzle row.

Also, each region of the head buffer is two-divided into the head buffer for upstream, 142*u*, and the head buffer for downstream, 142*l*. As shown in FIG. 3, the nozzle row provided at the head 41 of the printer 1 of this embodiment downstream side in the transport direction are called a "downstream nozzle group", and half of the nozzles (#91 to #180) on the upstream side in the transport direction are called an "upstream nozzle group". The head buffer for upstream, 142*u*, shown in FIG. 16 is a head buffer corresponding to the upstream nozzle group (#91 to #180), and the head buffer for downstream, 142*l*, is a head buffer corresponding to the downstream nozzle group (#1 to #90).

The controller 10 first stores dot data corresponding to a certain region among image data in the raster buffer for every ink color in order to print a certain region (for example, a region for one pass). Then, the controller 10 transmits the dot data stored in the raster buffer to the head buffer in accordance with printing timing. In this way, on the basis of the dot data stored in the head buffer, ink droplets are ejected from each nozzle row (YMCKW) of the head 41, so that an image is printed. In addition, after transmission of the dot data to the head buffer, the controller 10 stores new dot data in the raster buffer until the printing by all the dot data is finished.

Incidentally, in a case where the 5-color print mode is set in the printer 1 of this embodiment, a color image is printed on a background image of toned white, in which white ink (W) and color ink (YMCK) are mixed, by color ink (YMCK). At the time of the normal printing (for example, Pass 4 or Pass 5 of FIG. 9), a background image of toned white is printed by the nozzles (#91 to #180) of a half on the upstream side in the transport direction of each of the white nozzle row W and the color nozzle row Co, and a color image is printed by the nozzles (#1 to #90) of a half on the downstream side in the transport direction of the color nozzle row Co. Therefore, at the time of the normal printing, the controller 10 transmits the dot data stored in the raster buffer for a color image, 132*c*, to the head buffer for downstream, 142*l*, and transmits the dot data stored in the raster buffer for a white image, 132*w*, to the head buffer for upstream, 142*u*. By this, it is possible to print the color image by the nozzles of a half on the downstream side in the transport direction of the color nozzle row Co and print the background image by the nozzles of a half on the upstream side in the transport direction of each of the color nozzle row Co and the white nozzle row W.

Further, in this embodiment, at the time of the upper end printing and the time of the lower end printing, the printing is performed by using the nozzles different from those at the time of the normal printing. At the time of the upper end printing (for example, Pass 1 or Pass 2 of FIG. 9), a background image is printed by using the nozzles (#1 to #90) on the downstream side in the transport direction of the white nozzle row W and the color nozzle row Co. Therefore, the controller 10 transmits the dot data stored in the raster buffer for a white image, 132*w*, to the head buffer for downstream, 142*l*, at the time of the upper end printing.

On the other hand, at the time of the lower end printing (for example, Pass 9 or Pass 10 of FIG. 10), a color image is printed by using the nozzles (#91 to #180) on the upstream side in the transport direction of the color nozzle row Co. Therefore, the controller 10 transmits the dot data stored in the raster buffer for a color image, 132*c*, to the head buffer for upstream, 142*u*, at the time of the lower end printing.

Also, there is also a case where a color image is first printed on a medium (a transparency film), and a background image of toned white is then printed on the color image. In this case, at the time of the normal printing, a color image is first printed by the nozzles on the upstream side in the transport direction of the color nozzle row Co, and a background image of toned white is then printed on the color image by the nozzles on the downstream side in the transport direction of the white nozzle row W and the color nozzle row Co. Therefore, the controller 10 transmits the dot data stored in the raster buffer for a color image, 132*c*, to the head buffer for upstream, 142*u*, and transmits the dot data stored in the raster buffer for a white image, 132*w*, to the head buffer for downstream, 142*l*.

Other Embodiments

In each embodiment described above, a printing system having an ink jet printer has been typically described. However, the disclosure of an upper end printing method or the like is included. Also, the above-described embodiments are for facilitating the understanding of the invention, but are not intended to construe the invention as being limited thereto. The invention can be modified or improved without departing from the purpose thereof, and it is also needless to say that the equivalents thereto are included in the invention. In particular, embodiments which are described below are also included in the invention.

Concerning Upper End and Lower End Printing Process

In the above-described embodiments, the nozzles which print a background image at the time of the upper end printing are set to be the nozzles further on the downstream side in the transport direction than the nozzles which print a background image at the time of the normal printing, and the nozzles which print a color image at the time of the lower end printing are set to be the nozzles further on the upstream side in the transport direction than the nozzles which print a color image at the time of the normal printing. However, the invention is not limited thereto. A configuration may also be made such that only at the time of the upper end printing, a background image is printed by the nozzles different from those at the time of the normal printing and at the time of the normal printing and the time of the lower end printing, the nozzles which print a background image and the nozzles which print a color image are fixed. Conversely, a configuration may also be made such that only at the time of the lower end printing, a color image is printed by the nozzles different from those at the time of the normal printing and at the time of the normal printing and the time of the upper end printing, the nozzles which print a background image and the nozzles which print a color image are fixed.

Concerning Background Image of Toned White

Also, in the above-described embodiments, a case where a background image of toned white is printed by white ink and color ink and a color image is printed on the background image only by color ink (YMCK) is taken as an example. However, the invention is not limited thereto. For example, a configuration may also be made such that a background image is printed only by white ink and a color image is printed on the background image by white ink and color ink (YMCK) in order to increase color reproducibility. In this case, for example, at the time of the normal printing, a background image is printed by the nozzles (for example, the nozzles #13 to #24 of FIG. 9) on the upstream side in the transport direction of the white nozzle row W and a color image is printed by the nozzles (for example, the nozzles #1 to #12 of FIG. 9) on the downstream side in the transport direction of the color nozzle row Co and the white nozzle row W. Then, it is preferable if the nozzles (the color nozzles and the white nozzles) for printing a color image at the time of the lower end printing are set to be the nozzles further on the upstream side in the transport direction than the nozzles (the color nozzles and the white nozzles) for printing a color image at the time of the normal printing. Also, a color image may also be printed on a background image of toned white by white ink and color ink. Also, ink for printing a background image is not limited to white ink, but another ink (for example, metallic color ink or the like) may also be used. Also in this case, a hue of a background image may also be adjusted by mixing ink (for example, color ink YMC or the like) which forms an image on the background image to ink which prints the background image.

Concerning Printed Matter

In the above-described embodiments, a printed matter in which a background image of toned white is printed by white ink and a color ink (YMCK) and a color image is printed on the background image by color ink is taken as an example. However, the invention is not limited thereto. For example, a printed matter may also be adopted in which a background image of toned white is printed on a medium by white ink and color ink, a color image is printed on the background image, and finally, coating is performed by clear ink. In this case, for example, at the time of the normal printing, the background image is printed by the nozzles of ⅓ on the upstream side in the transport direction of the white nozzle row W and the color nozzle row Co, the color image is printed by the nozzles of ⅓ of the central portion of the color nozzle row Co, and the coating is performed by the nozzles of ⅓ on the downstream side in the transport direction of a clear ink nozzle row. Then, at the time of the upper end printing or the time of the lower end printing, it is preferable if the nozzles different from those at the time of the normal printing are used.

Concerning Printing Method

In the above-described embodiments, the band printing and the overlap printing are taken as an example. However, the invention is not limited thereto. Another printing method (for example, a printing method in which like interlace printing, a plurality of raster lines is formed between raster lines which are arranged at nozzle pitch intervals, in a different pass) may also be adopted. Also in another printing method, it is preferable if the nozzles which print a background image and the nozzles which print a color image are not fixed and, for example, at the time of the upper end printing, a background image is printed by using the nozzles on the downstream side in the transport direction.

Concerning Fluid Ejecting Apparatus

In the above-described embodiments, as the fluid ejecting apparatus, the ink jet printer has been illustrated. However, the invention is not limited thereto. If it is a fluid ejecting apparatus, the invention is also applicable to various industrial apparatuses besides a printer. The invention is also applicable to, for example, a printing apparatus for applying a pattern on a cloth, a color filter manufacturing apparatus, an apparatus for manufacturing a display such as an organic EL display, a DNA chip manufacturing apparatus which manufactures a DNA chip by applying solution, in which DNA is melted, on a chip, or the like.

Also, a fluid ejecting method may also be a piezo method which ejects fluid by expanding or contracting an ink chamber by application of a voltage to a driving element (piezo element), or a thermal method which generates air bubbles in a nozzle by using a heater element and ejects liquid by the air bubbles.

Also, ink which is ejected from the head 41 may also be ultraviolet cure type ink which is cured by irradiation of ultraviolet rays. In this case, it is preferable if a head which ejects the ultraviolet cure type ink and an irradiator which irradiates the ultraviolet cure type ink with the ultraviolet rays are mounted on the carriage 31. Also, powder may also be ejected from a head.

What is claimed is:

1. A fluid ejecting apparatus comprising:

(1) a first nozzle row in which first nozzles that eject first fluid are arranged in a row in a given direction;

(2) a second nozzle row in which second nozzles that eject second fluid are arranged in a row in the given direction;

(3) a movement mechanism which moves the first nozzle row and the second nozzle row with respect to a medium in a moving direction intersecting the given direction;

(4) a transport mechanism which transports the medium with respect to the first nozzle row and the second nozzle row in the given direction; and (5) a control section which repeats an image formation operation for ejecting fluid from the first nozzles and the second nozzles while moving the first nozzle row and the second nozzle row in the moving direction by the movement mechanism and a transport operation for transporting the medium with respect to the first nozzle row and the second nozzle row in the given direction by the transport mechanism, wherein in a case where after the formation of a first image layer by the first fluid and the second fluid in a certain image formation operation, a second image layer is formed on the first image layer by the second fluid in another image formation operation, at the time of normal image formation, the first nozzles and the second nozzles for forming the first image layer are set to be nozzles which are located further on the upstream side in the given direction than the second nozzles for forming the second image layer, and at the time of image formation of an upper end portion of the medium, the first nozzles and the second nozzles for forming the first image layer are set to be nozzles which are located further on the downstream side in the given direction than the first nozzles and the second nozzles for forming the first image layer at the time of the normal image formation, wherein at least part of a first nozzle group which forms the first image layer in the first nozzle row overlaps in the moving direction at least part of a second nozzle group which forms the first image layer in the second nozzle row.

2. The fluid ejecting apparatus according to claim 1, wherein at the time of image formation of a lower end portion of the medium, the control section sets the second nozzles for forming the second image layer to be nozzles which are located further on the upstream side in the given direction than the second nozzles for forming the second image layer at the time of the normal image formation.

3. The fluid ejecting apparatus according to claim 2, wherein in a case where the second image layer is formed by the second fluid and the first fluid, the control section sets, at the time of the normal image formation, the first nozzles for forming the second image layer to be nozzles which are located further on the downstream side in the given direction than the first nozzles for forming the first image layer and sets, at the time of the image formation of the lower end portion of the medium, the first nozzles for forming the second image layer to be nozzles which are located further on the upstream side in the given direction than the first nozzles for forming the second image layer at the time of the normal image formation.

4. A fluid ejecting apparatus comprising:

(1) a first nozzle row in which first nozzles that eject first fluid are arranged in a row in a given direction;

(2) a second nozzle row in which second nozzles that eject second fluid are arranged in a row in the given direction;

(3) a movement mechanism which moves the first nozzle row and the second nozzle row with respect to a medium in a moving direction intersecting the given direction;

(4) a transport mechanism which transports the medium with respect to the first nozzle row and the second nozzle row in the given direction; and (5) a control section which repeats an image formation operation for ejecting fluid from the first nozzles and the second nozzles while moving the first nozzle row and the second nozzle row in the moving direction by the movement mechanism and a transport operation for transporting the medium with respect to the first nozzle row and the second nozzle row in the given direction by the transport mechanism, wherein in a case where after the formation of a first image layer by the first fluid in a certain image formation operation, a second image layer is formed on the first image layer by the first fluid and the second fluid in another image formation operation, at the time of normal image formation, the first nozzles and the second nozzles for forming the second image layer are set to be nozzles which are located further on the downstream side in the given direction than the first nozzles for forming the first image layer, and at the time of image formation of a lower end portion of the medium, the first nozzles and the second nozzles for forming the second image layer are set to be nozzles which are located further on the upstream side in the given direction than the first nozzles and the second nozzles for forming the second image layer at the time of the normal image formation, and wherein at least part of a first nozzle group which forms the first image layer in the first nozzle row overlaps in the moving direction at least part of a second nozzle group which forms the first image layer in the second nozzle row.

5. The fluid ejecting apparatus according to claim 4, wherein at the time of image formation of an upper end portion of the medium, the control section sets the first nozzles for forming the first image layer to be nozzles which are located further on the downstream side in the given direction than the first nozzles for forming the first image layer at the time of the normal image formation.

6. A fluid ejecting method in which by a fluid ejecting apparatus where an image formation operation for ejecting fluid from first nozzles and second nozzles while moving a first nozzle row, in which the first nozzles that eject first fluid are arranged in a row in a given direction, and a second nozzle row, in which the second nozzles that eject second fluid are arranged in a row in the given direction, in a moving direction intersecting the given direction and a transport operation for transporting a medium with respect to the first nozzle row and the second nozzle row in the given direction are repeated, after the formation of a first image layer by the first fluid and the second fluid in a certain image formation operation, a second image layer is formed on the first image layer by the second fluid in another image formation operation, the method comprising:

ejecting fluid by setting the first nozzles and the second nozzles for forming the first image layer to be nozzles which are located further on the upstream side in the given direction than the second nozzles for forming the second image layer, at the time of normal image formation; and ejecting fluid by setting the first nozzles and the second nozzles for forming the first image layer to be nozzles which are located further on the downstream side in the given direction than the first nozzles and the second nozzles for forming the first image layer at the time of the normal image formation, at the time of image formation of an upper end portion of the medium;

wherein at least part of a first nozzle group which forms the first image layer in the first nozzle row overlaps in the moving direction at least part of a second nozzle group which forms the first image layer in the second nozzle row.

* * * * *